US006830164B2

(12) United States Patent
Michaels et al.

(10) Patent No.: US 6,830,164 B2
(45) Date of Patent: Dec. 14, 2004

(54) POST-FOAMING GEL, CONTAINER THEREFOR AND APPARATUS AND METHOD FOR HEATING AND DISPENSING

(75) Inventors: Kenneth W. Michaels, County of McHenry, IL (US); Edward J. Kunesh, County of Racine, WI (US); David P. Mather, County of Milwaukee, WI (US); Thomas J. Szymczak, County of Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/995,063

(22) Filed: Nov. 27, 2001

(65) Prior Publication Data

US 2002/0074349 A1 Jun. 20, 2002

Related U.S. Application Data

(63) Continuation-in-part of application No. 09/722,860, filed on Nov. 27, 2000, now Pat. No. 6,415,957.

(51) Int. Cl.[7] ..... B65D 83/00

(52) U.S. Cl. ..... 222/402.1; 222/402.22; 222/402.23

(58) Field of Search ..... 222/394, 570, 222/402.1, 402.13, 402.22, 402.23, 464.1

(56) References Cited

U.S. PATENT DOCUMENTS

| | | | | | |
|---|---|---|---|---|---|
| 2,615,597 | A | * | 10/1952 | Tomasek et al. | 222/402.22 |
| 2,660,132 | A | * | 11/1953 | Pyenson | 425/461 |
| 2,704,622 | A | * | 3/1955 | Soffer | 222/402.11 |
| 2,729,368 | A | * | 1/1956 | Lapin et al. | 222/402.22 |
| 2,781,954 | A | | 2/1957 | Bretz, Jr. | 222/394 |
| 2,989,251 | A | | 6/1961 | Abplanalp et al. | 239/468 |
| 3,095,127 | A | | 6/1963 | Green | 222/394 |

(List continued on next page.)

FOREIGN PATENT DOCUMENTS

| | | | | |
|---|---|---|---|---|
| DD | 10 40 464 B | | 10/1958 | |
| DD | 29 17 918 A | | 11/1979 | |
| EP | 0 397 301 A1 | | 11/1990 | 9/12 |
| EP | 0 431 742 B1 | | 8/1995 | 9/12 |
| FR | 1099584 | * | 3/1955 | |
| FR | 1 099 584 A | | 9/1955 | |
| GB | 1 445 029 A | | 8/1976 | |
| GB | 1 445 029 | | 8/1976 | |
| GB | 2 021 698 A | | 12/1979 | |
| GB | 2 198 189 A | | 6/1988 | |
| JP | 0 7 330051 | | 12/1995 | |

OTHER PUBLICATIONS

International Publication No. WO 92/16188 published Oct. 1, 1992.

International Search Report dated May 21, 2003; PCT/US02/14421.

International Search Report, Appl. PCT/US02/38002 dated Mar. 6, 2003.

PCT/ISA/206 and Annexes, Appl. No. PCT/US02/14421 dated Feb. 13, 2003.

*Primary Examiner*—Frederick C. Nicolas

(57) ABSTRACT

A shave gel is disposed within a container having a container body defining a space for storage of the product and a valve in fluid communication with the space. A hollow stem is disposed in fluid communication with the valve and includes an exterior end that has at least one side opening therethrough. The valve is actuable to dispense product through the side opening.

25 Claims, 25 Drawing Sheets

U.S. PATENT DOCUMENTS

| | | | | | |
|---|---|---|---|---|---|
| 3,118,612 | A | | 1/1964 | Abplanalp | 239/579 |
| 3,150,803 | A | | 9/1964 | Green | 222/394 |
| 3,166,250 | A | | 1/1965 | Kappel | 239/337 |
| 3,180,536 | A | | 4/1965 | Meshberg | 222/394 |
| 3,282,469 | A | | 11/1966 | Skonberg | 222/146 |
| 3,431,749 | A | | 3/1969 | Bounds et al. | 62/293 |
| 3,433,419 | A | | 3/1969 | Evesque | 239/470 |
| 3,495,922 | A | * | 2/1970 | Steinman | 401/190 |
| 3,549,055 | A | * | 12/1970 | Lawrence | 222/182 |
| 3,572,591 | A | | 3/1971 | Brown | 239/337 |
| 3,591,128 | A | * | 7/1971 | Ramis | 251/100 |
| 3,743,189 | A | * | 7/1973 | Macquire-Cooper | 239/579 |
| 3,912,132 | A | | 10/1975 | Stevens | 222/402.1 |
| 3,942,725 | A | | 3/1976 | Green | 239/468 |
| 4,046,289 | A | | 9/1977 | Teranishi | 222/146 |
| 4,094,446 | A | | 6/1978 | Brutsman | 222/146 |
| 4,239,407 | A | * | 12/1980 | Knight | 401/190 |
| 4,410,110 | A | | 10/1983 | Del Bon et al. | 222/402.24 |
| 4,437,592 | A | | 3/1984 | Bon | 222/402.12 |
| 4,517,445 | A | | 5/1985 | Tatsumi et al. | 219/297 |
| 4,528,111 | A | | 7/1985 | Su | 252/107 |
| 4,572,410 | A | * | 2/1986 | Brunet | 222/402.11 |
| 4,801,093 | A | | 1/1989 | Brunet et al. | 239/490 |
| 4,852,807 | A | | 8/1989 | Stoody | 239/337 |
| 4,969,577 | A | | 11/1990 | Werding | 222/94 |
| 5,310,092 | A | | 5/1994 | Targell | 222/167 |
| 5,379,924 | A | | 1/1995 | Taylor | 222/402.11 |
| 5,385,303 | A | | 1/1995 | Gosselin et al. | 239/394 |
| 5,411,184 | A | | 5/1995 | Smrt | 222/402.13 |
| 5,489,047 | A | | 2/1996 | Winder | 222/325 |
| 5,676,184 | A | * | 10/1997 | Houser | 141/90 |
| 5,775,321 | A | | 7/1998 | Alband | 128/200.23 |
| 5,902,778 | A | | 5/1999 | Hartmann et al. | 510/135 |
| 5,915,598 | A | | 6/1999 | Yazawa et al. | 222/402.1 |
| 6,053,433 | A | | 4/2000 | Py | 239/574 |
| 6,113,070 | A | | 9/2000 | Holzboog | 251/342 |
| 6,241,131 | B1 | | 6/2001 | Katsuda et al. | 222/477 |
| 6,321,742 | B1 | | 11/2001 | Schmidt et al. | 126/38 |
| 6,343,722 | B1 | | 2/2002 | Di Giovanni | 222/402.1 |
| 6,415,957 | B1 | * | 7/2002 | Michaels et al. | 222/146.3 |
| 6,415,989 | B1 | | 7/2002 | Lasserre et al. | 239/1 |
| 6,491,189 | B2 | | 12/2002 | Friedman | 222/518 |
| 2002/0017532 | A1 | | 2/2002 | Aiken et al. | |

* cited by examiner

POST-FOAMING GEL, CONTAINER THEREFOR AND APPARATUS AND METHOD FOR HEATING AND DISPENSING

The present application comprises a continuation-in-part of U.S. application Ser. No. 09/722,860, filed Nov. 27, 2000, now U.S. Pat. No. 6,415,957 and owned by the assignee of the present application.

TECHNICAL FIELD

The present invention relates generally to dispensing apparatus and methods, and more particularly to an apparatus and method for dispensing a heated post-foaming gel.

BACKGROUND ART

Shaving lather dispensers that dispense heated shaving lather have been known for some time. For example, Rossi U.S. Pat. No. 3,335,910 discloses a heatable shaving lather dispenser including a housing, an elongate heat conductive block and a heater disposed in a channel in the block. A lather-carrying duct extends through the block in heat transfer relationship with the heater and a first end of the duct is in fluid communication with an aerosol container. A second end of the duct has a selectively operable valve disposed therein. The duct is maintained at container pressure and the valve is actuable to dispense heated lather into the hand of a user.

Wilkins U.S. Pat. No. 3,498,504 discloses a heated aerosol lather dispenser having a casing, a lather-containing pressurized aerosol container retained in the casing and a head disposed above the aerosol container. The head includes an electrically heated block having a passage therethrough in fluid communication with the lather in the container. A valved outlet is provided between the passage and a discharge spout and is selectively actuable to dispense lather.

Post-foaming shaving materials have been developed which are designed to be dispensed in gel form. The post-foaming shave gel may then be applied to the skin of the user and, in the course of such application, the post-foaming shave gel is worked in a fashion that causes the gel to foam. While such gels are effective to prepare the skin of the user for shaving, it is believed that the skin preparation effect and/or shaving comfort are enhanced when the gel is heated and then applied to the skin. However, known dispensing devices, such as those disclosed in the Rossi and Wilkins patents described above, are not designed specifically for use with such gels, and, in fact, use of such dispensers and can result in undesirable premature foaming of the gel.

SUMMARY OF THE INVENTION

In accordance with one aspect of the present invention, a container for product includes a container body defining a space for storage of the product and a valve in fluid communication with the space. A hollow stem is disposed in fluid communication with the valve and includes an exterior end that has at least one side opening therethrough. The valve is actuable to dispense product through the side opening.

According to a further aspect of the present invention, a container for use with dispensing apparatus that dispenses pressurized product stored in the container includes a container body defining a space for storage of the product and a valve in fluid communication with the space. A hollow stem is disposed in fluid communication with the valve and includes an exterior end that has at least one side opening therethrough. The stem is adapted for engagement with the apparatus to permit dispensing of product through the at least one side opening into the dispensing apparatus.

A further alternative aspect of the present invention comprehends a combination of a dispenser adapted to dispense product and a container of pressurized product disposed in the dispenser and engaged by a coupling assembly of the dispenser. The container includes a container body defining a space for storage of the product and a container valve in fluid communication with the space. A hollow stem is disposed in fluid communication with the valve and has an exterior end that has at least one side opening therethrough. The container valve is adapted for engagement with a dispenser inlet valve to permit dispensing of product through the at least one side opening into the dispensing apparatus.

In accordance with yet another aspect of the present invention, a method of dispensing a heated gel includes the steps of providing a housing having a recess therein and a heater assembly disposed in the housing. The heater assembly includes a heater selectively operable to develop heat and a heat exchanger in heat transfer relationship with the heater and having a chamber, wherein the heater assembly further includes a first valve in fluid communication with the chamber and a second valve operable to permit fluid flow out of the chamber. The method further includes the steps of providing a container of pressurized gel, the container including a third valve and a hollow stem in fluid communication with the third valve and having at least one side opening therethrough, placing the hollow stem in fluid communication with the first valve, opening the first and third valves to expose the chamber to pressurized gel and opening the second valve to allow dispensing of gel without substantial foaming.

In accordance with a still further aspect of the present invention, a shave gel comprises a mixture of a soap and a propellant, wherein a ratio of soap to propellant is about six or more parts of soap to one part of propellant by weight. The propellant is in a range between about 0.25 percent and about 3.50 percent by weight of a total composition of the gel, and the propellant has a vapor pressure less than or equal to about 40 psia.

Other aspects and advantages of the present invention will become apparent upon consideration of the following detailed description.

DESCRIPTION OF THE PREFERRED EMBODIMENTS

Figure 1:
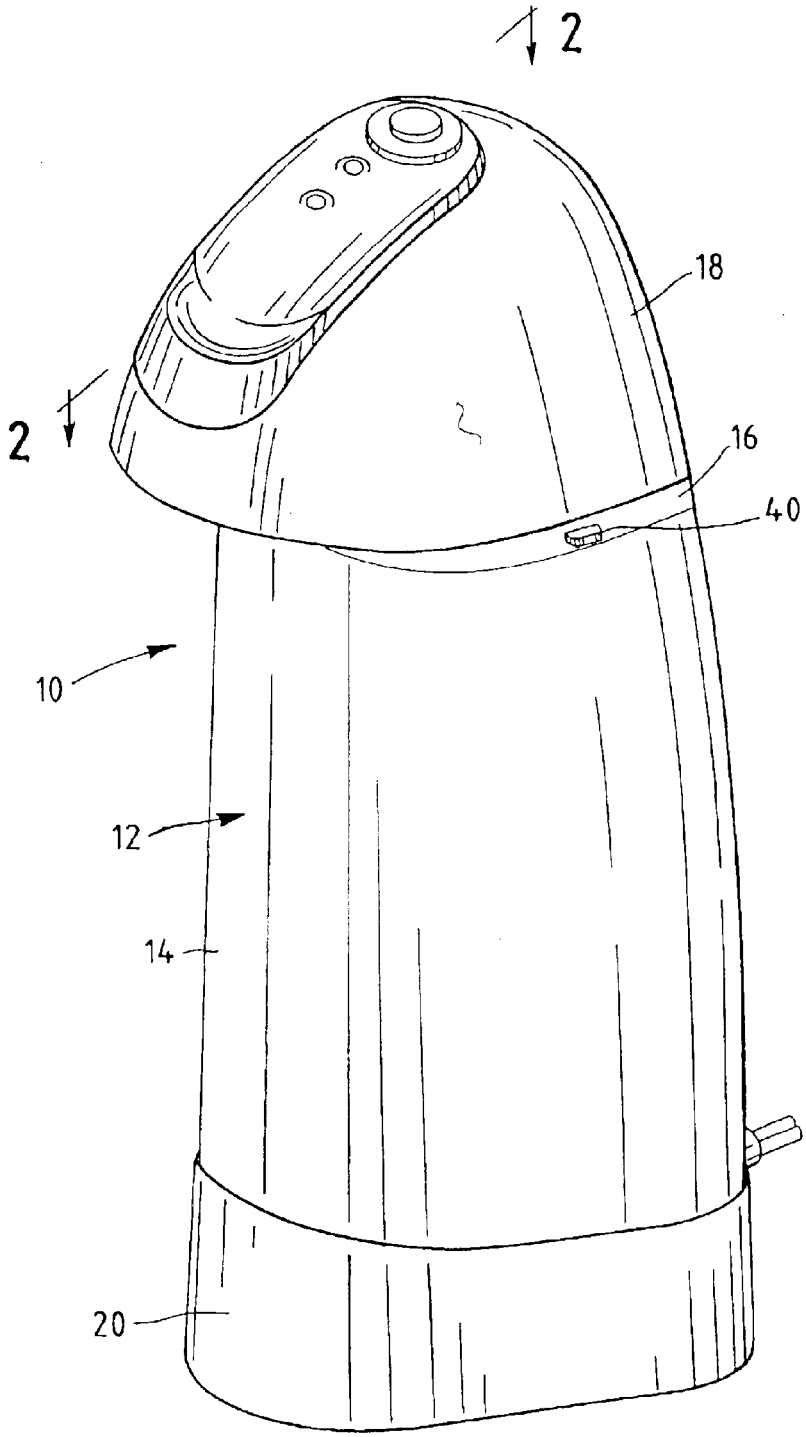
FIG. 1 is an isometric view of an apparatus according to the present invention.
Figure 2:
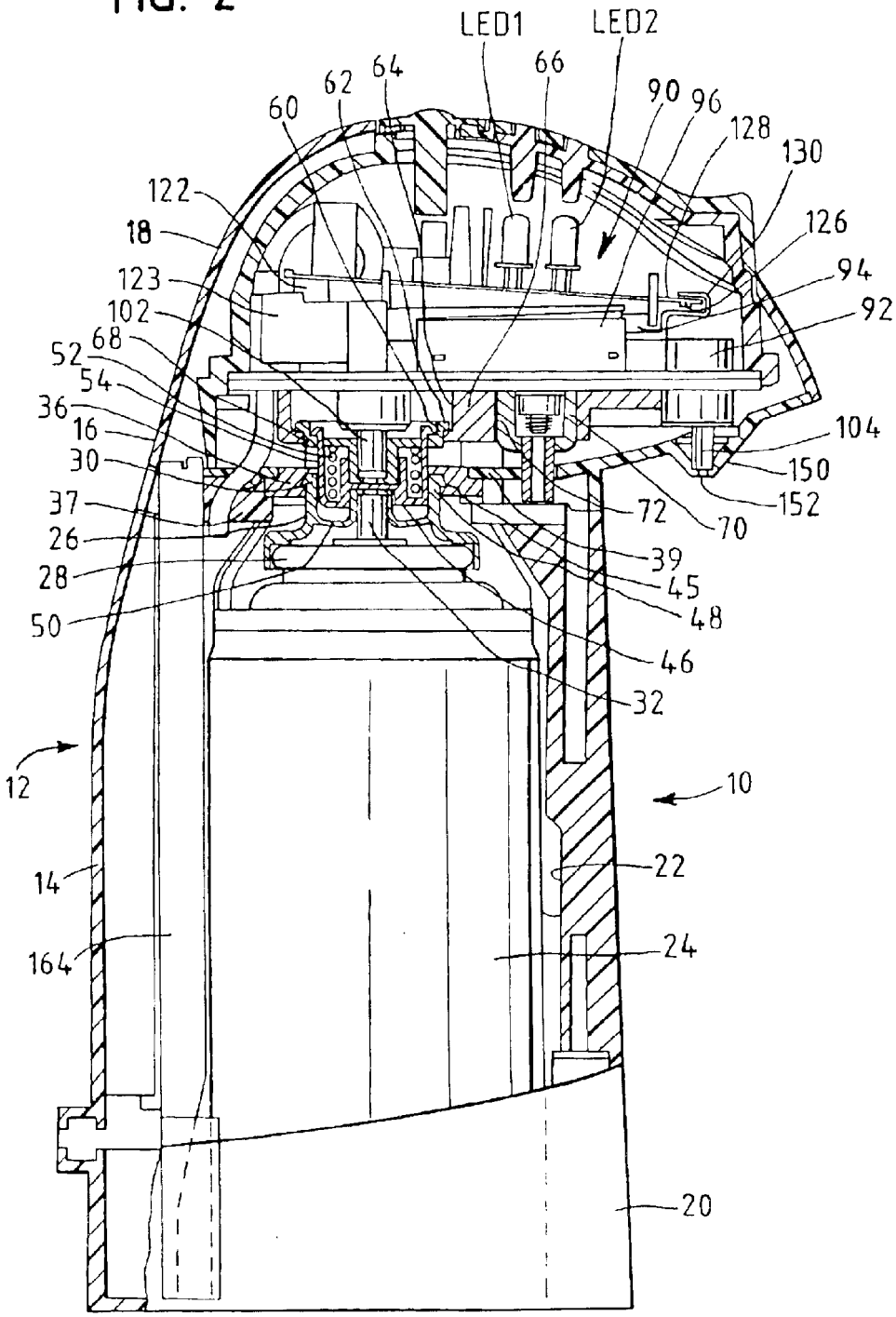
FIG. 2 is a partial sectional view of the apparatus of FIG. 1 together with a can of pressurized shave gel taken generally along the lines 2—2 of FIG. 1.
Figure 3:
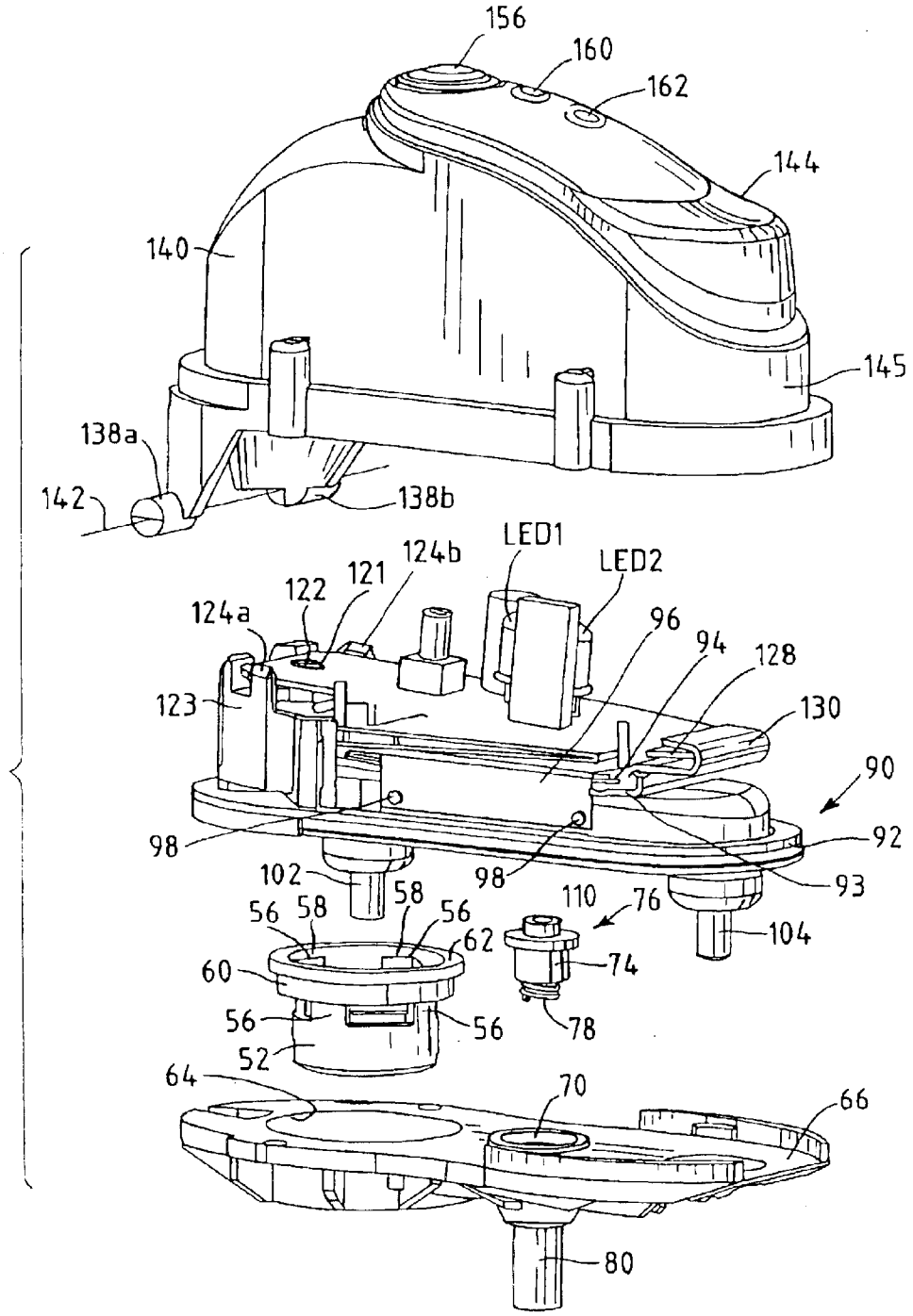
FIG. 3 is an exploded and enlarged isometric view of a portion of the apparatus of FIG. 1.
Figure 4:
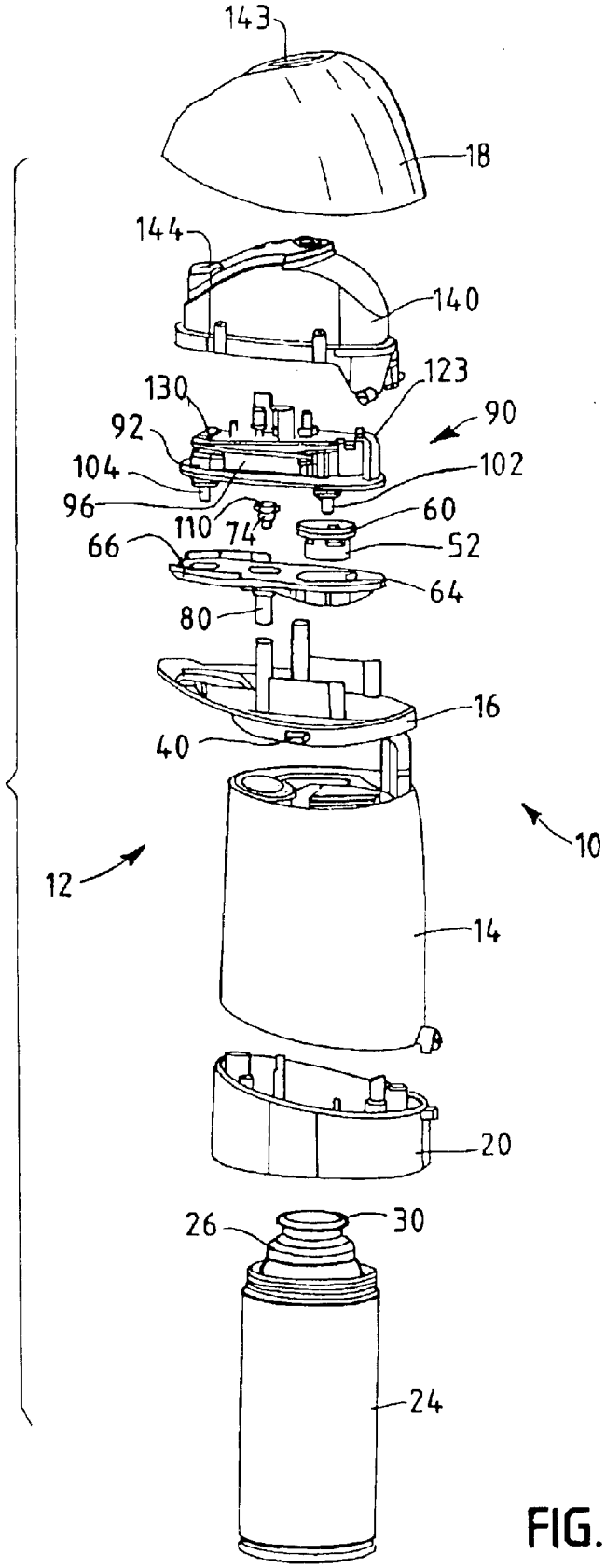
FIG. 4 is an exploded isometric view of the rear of the apparatus of FIG. 2.

Referring now to FIGS. 1, 2 and 4, a dispensing apparatus 10 according to the present invention includes a housing 12 having a main body portion 14 joined in any suitable fashion, such as by screws, to a collar portion 16 and an upper portion 18. The main body portion 14 is further joined by screws or any other suitable fastener(s) to a base portion 20. The portions 14, 16, 18 and 20 are fabricated of any suitable material, such as polycarbonate.

The housing 12 defines a recess 22 (FIG. 2) within which may be disposed a pressurized can 24 containing shaving gel. The post-foaming shave gel preferably is of the type disclosed in Szymczak U.S. Pat. No. 5,858,343, owned by the assignee of the present application and the disclosure of which is incorporated by reference herein. Alternatively, in a highly preferred form of the present invention, the shave gel comprises a composition of soap and a single propellant (such as isopentane) or multiple propellants together with additives in a preferred ratio of six or more parts soap to one part propellant by weight. Also preferably, the propellant comprises between about 0.25 per cent and about 3.50 per cent by weight of the total gel composition, with about 2.25 per cent by weight of the total gel composition being most preferred. Still further, the vapor pressure of the propellant is preferably less than or about equal to 40 psia, and is most preferably about equal to 33.7 psia, which is the approximate vapor pressure of isopentane at 130 degrees Fahrenheit. Such a formulation, in combination with the heating process described hereinafter, results in a heated shave gel that does not post-foam prematurely to a significant degree but which readily post-foams when applied and rubbed on the skin. It is believed that heating of the shave gel results in a closer and more comfortable shave.

Figure 5:
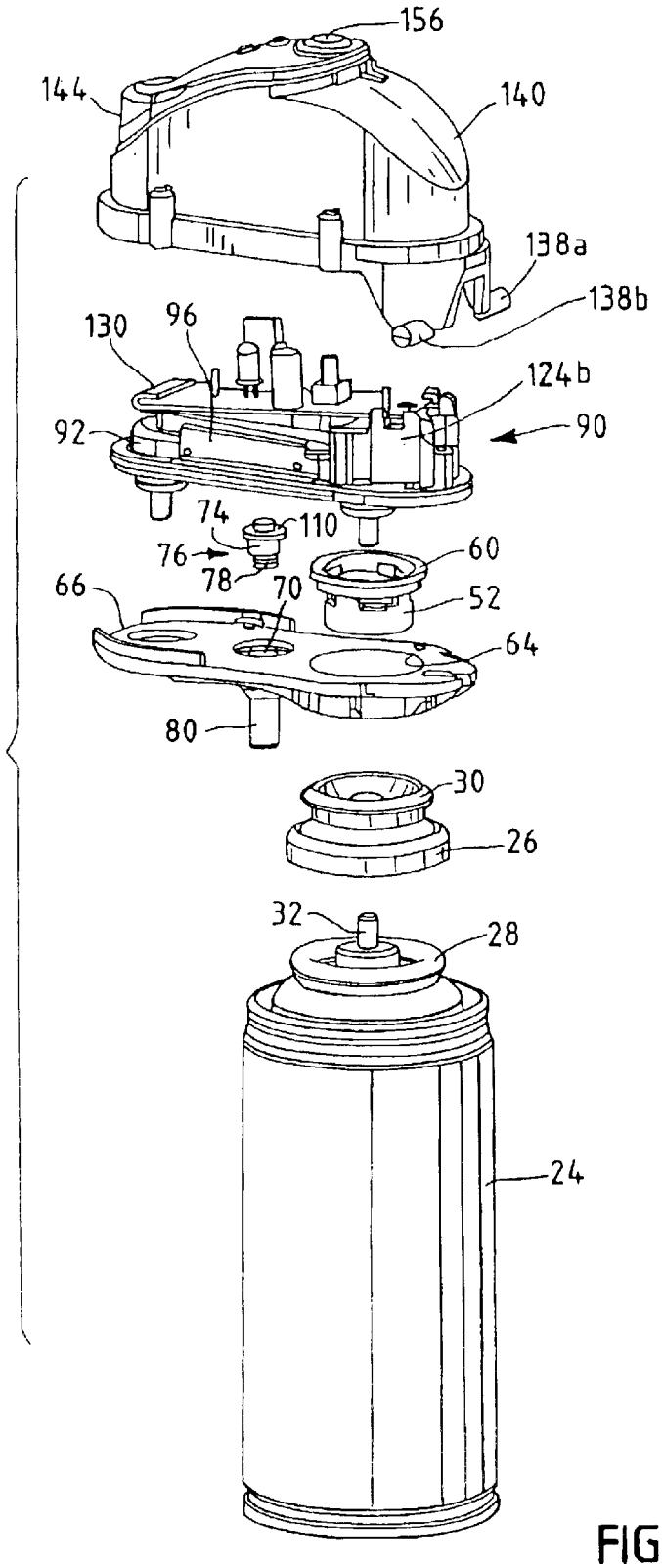
FIG. 5 is an exploded and enlarged isometric view of a portion of the apparatus of FIG. 4.
Figure 6:
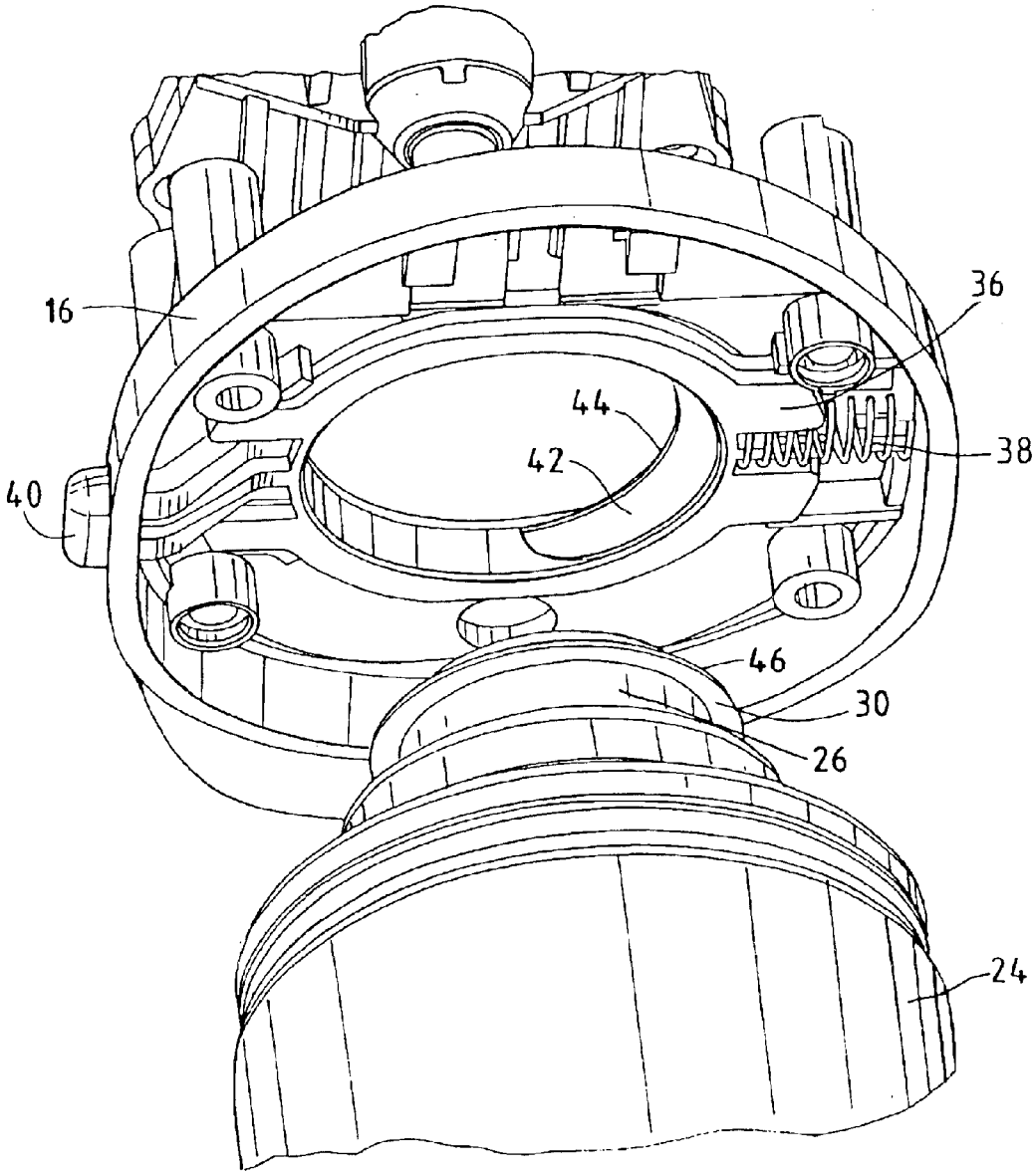
FIG. 6 is an enlarged isometric view of the underside of a collar portion illustrating a can coupling assembly.

Referring also to FIG. 5, the can 24 includes a coupling cap 26 carried on an upper annular rim 28. A series of three inwardly extending tabs (not shown) are carried by the cap 26 at a lower end thereof and the tabs are disposed below the rim 28 to maintain the cap 26 on the can 24. The coupling cap 26 includes an annular flange 30 and surrounds a conventional resilient spring-loaded aerosol valve 32 disposed in the can 24. Referring to FIGS. 2, 4 and 6, the collar portion 16 includes a coupling assembly 34 comprising a coupling ring 36 that is biased toward an engaged position by a spring 38. The coupling ring 36 is disposed between and restrained against axial movement by an upper wall 37 of the main body portion 14 and a wall 39 of the collar portion 16 (FIG. 2). The coupling ring 36 may be moved against the force of the spring 38 toward a disengaged position by pushing on a button 40 extending outwardly through an aperture in the collar portion 16. When the can 24 is inserted upwardly in the recess 22, the annular flange 30 engages a sloped surface 42 (FIG. 6), thereby displacing the coupling ring 36 toward the disengaged position until an edge 44 of the sloped surface 42 reaches an outer edge 45 of the annular flange 30. At this point, the edge 44 of the sloped surface 42 rides over the edge 45 and the coupling ring 36 snaps under the force of the spring 38 into the engaged position whereby the portion of the coupling ring 36 carrying the sloped surface 42 is disposed in interfering relationship with the annular flange 30. In addition, also referring to FIG. 12, as the can 24 is being pushed upwardly, a tapered outer surface 47 of a central portion 46 of the coupling cap 26 contacts a sloped surface 51 of a coupling cover 52 that is resiliently biased by a spring 54. The central portion 46 of the coupling cap 26 is connected to an outer wall 48 of the cap 26 by a series of four fingers 50 (two of which are visible in FIGS. 2 and 12). Preferably, the sloped surface 51 forms an angle relative to a horizontal line in FIG. 12, which is 1–2 degrees less than the included angle between the tapered outer surface 47 and a horizontal line. Also a circumferential groove 53 is disposed in an upper surface of the central portion 46, which results in a degree of flexibility of an upper part 55 of the portion 46. Thus, as the can 24 is pushed upwardly and the force exerted by the spring 54 is overcome, the upper part 55 of the tapered outer surface 47 is compressed and seals against the sloped surface 51. In addition, the pressure exerted on the portion 46 causes the can valve 32 to open. However, the sealing of the upper part 55 against the sloped surface 47 prevents gel from escaping into the space surrounding the central portion 46.

Thereafter, when it is desired to remove the can 24 from the recess 22, a user need only depress the button 40 to cause the coupling ring 36 to move to the disengaged position whereupon the spring 54, the resilient can valve 32 and a further spring-loaded resilient valve described hereinafter urge the can 24 downwardly out of the recess 22.

Referring to FIGS. 2–5 and 12, the coupling cover 52 includes a series of four legs 56 having outwardly directed flanges 58. The coupling cover 52 is disposed in a ring 60 such that the flanges 58 engage a stepped inner surface of the ring 60. The ring 60 and the coupling cover 52 are disposed in a stepped counterbore 64 in a mounting plate 66 such that an outer flange 62 of the ring 60 abuts a shoulder 68 (FIG. 2) partially defining the counterbore 64. An o-ring 69 provides a seal between the coupling cover 52 and the ring 60.

Figure 12:
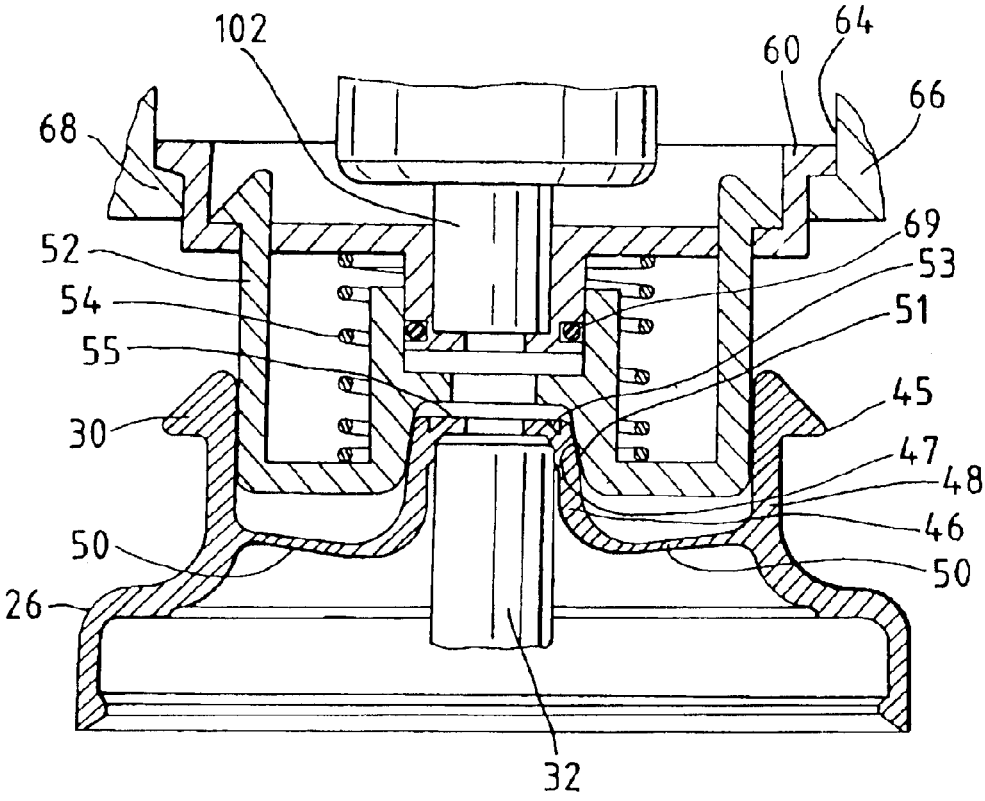
FIG. 12 is an enlarged, fragmentary, full sectional view illustrating the engagement of the coupling cap with the coupling cover.
Figure 15:
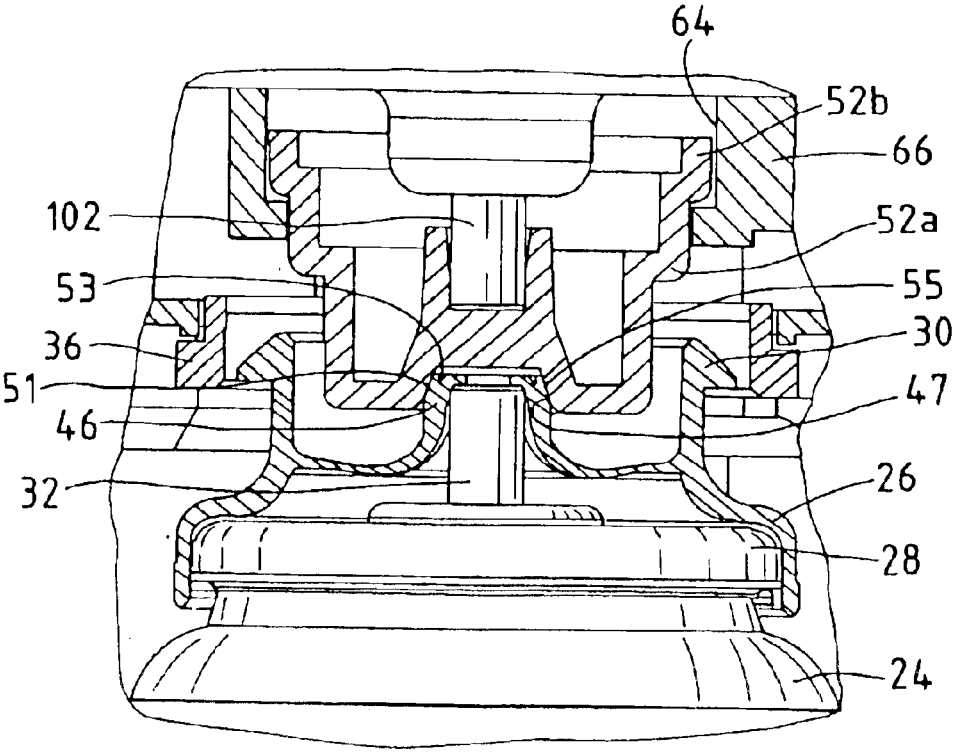
FIG. 15 is a full sectional view of an alternative embodiment of the present invention.
Figure 16:
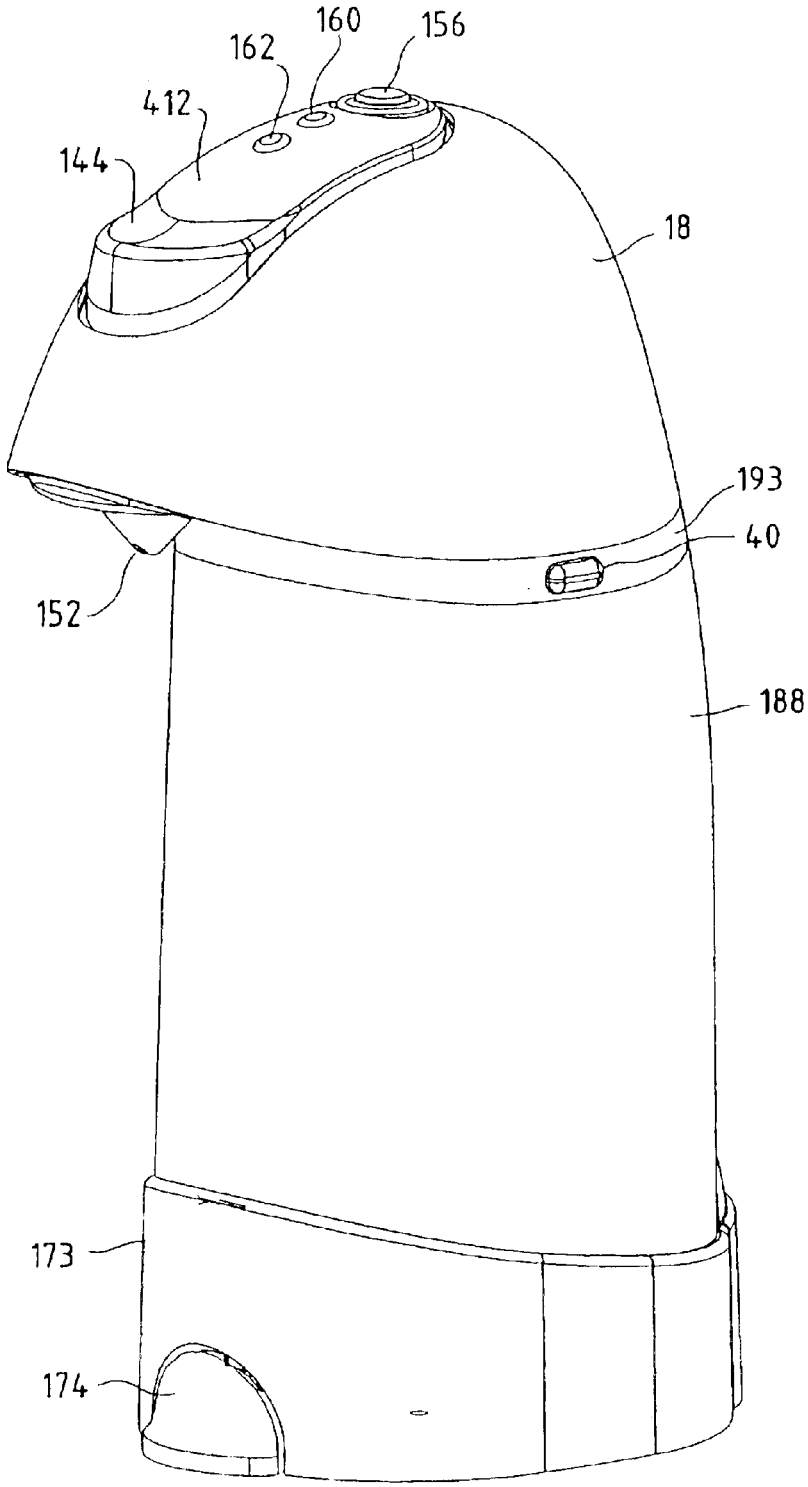
FIG. 16 is an isometric view of another embodiment of the present invention.

FIG. 15 illustrates an alternative embodiment wherein structures common to FIGS. 12 and 15 are assigned like reference numerals. In the embodiment of FIG. 15, the coupling cover 52, the spring 54, the ring 60 and the o-ring 69 are replaced by a coupling cover 52*a* that is retained in the stepped counterbore 64. The coupling cover 52*a* is axially movable a short distance owing to a clearance provided between the walls defining the counterbore 64 and a circumferential flange 52*b* of the coupling cover 52*a*. This embodiment relies upon the resiliency of the can valve 32 and the further resilient valve described hereinafter to eject the can 24 from the recess 22.

Referring again to FIGS. 2–5, the mounting plate 66 further includes a cylindrical hollow insert 70 that is retained by any suitable means in a bore 72. A plunger 74 of a pressure relief valve 76 is disposed together with a spring 78 in the insert 70. The insert 70 is open at both ends and is in fluid communication with an exit tube 80.

Referring to FIGS. 2–5, 10 and 11, a heater assembly 90 is disposed atop the mounting plate 66. The heater assembly includes a heat exchanger 92, a heat distributor plate 93 disposed atop the heat exchanger 92, an electrical resistance heater 94 disposed atop the heat distributor plate 93 and a retainer clip 96 that maintains the elements 92–94 in assembled relationship. The heat exchanger 92 and distributor plate 93 are fabricated of any suitable heat conductive materials, such as copper. The resistance heater 94 preferably comprises a 26-watt resistive element wound on a mica core and is wrapped in electrical insulation. The electrical insulation comprises a resin impregnated with mica wherein the impregnated resin is bonded to a glass cloth. The retainer clip 96 is made of any suitable material, such as stainless steel, and is sufficiently flexible to allow the legs thereof to deform and snap over sidewalls of the heat exchanger 92 such that raised portions 97 (FIGS. 10 and 11) of the heat exchanger 92 reside in apertures 98 in the clip 96. This interfering fit of the raised portions with the apertures 98 securely fixes the clip 96 and the elements 93 and 94 on the heat exchanger 92.

Figure 8:
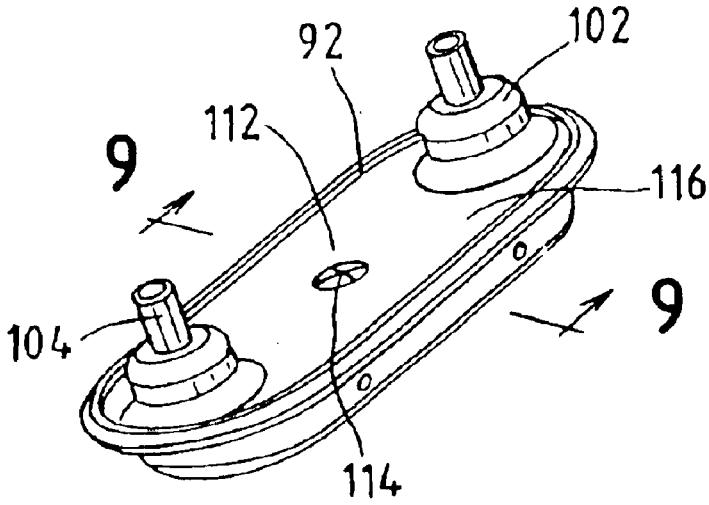
FIG. 8 is an isometric view of an underside of the heat exchanger of FIGS. 2–5.
Figure 9:
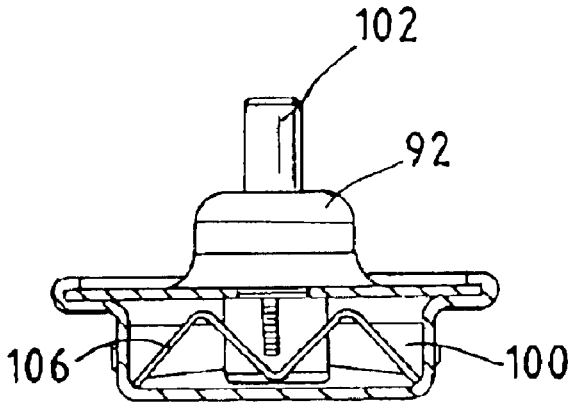
FIG. 9 is a sectional view taken generally along the lines 9—9 of FIG. 8.

Referring also to FIGS. 8 and 9, the heat exchanger 92 includes a chamber 100 therein. A first resiliently biased valve 102 is in fluid communication with a first portion of the chamber 100 and a second resiliently biased valve 104 is in fluid communication with a second portion of the chamber 100. Preferably, each of the first and second valves 102,104 comprises a conventional valve used in pressurized aerosol cans. Alternatively, one or more of the valves 32, 102 and 104 may be of the type disclosed in U.S. Pat. Nos. 4,442,959; 4,493,444; 4,522,318; and 4,532,690. The heat exchanger 92 also preferably includes a folded internal wall 106 (FIG. 9) that is also preferably made of copper and that serves to increase the heat transfer ability of the heat exchanger 92. It is believed that the folded internal wall 106 may assist in mixing the gel in the heat exchanger 92 to reduce the incidence of localized hot spots or cold spots in the gel. The chamber 100 is sized to accommodate approximately five to seven grams, and, more specifically, approximately six grams of shaving gel.

Referring to FIGS. 2–5 and 8, a washer-shaped gasket 110 is carried by the plunger 74 and bears and seals against a sealing surface 112 (FIG. 8) surrounding an opening 114 in a lower wall 116 (also seen in FIG. 8) of the heat exchanger 92. The plunger 74 is displaceable in a downward direction in response to an undesirably elevated pressure in the chamber 100 to vent material from the chamber out through the tube 80. The pressure at which this relief action takes place is determined in part by the stiffness of the spring 78.

Figure 10:
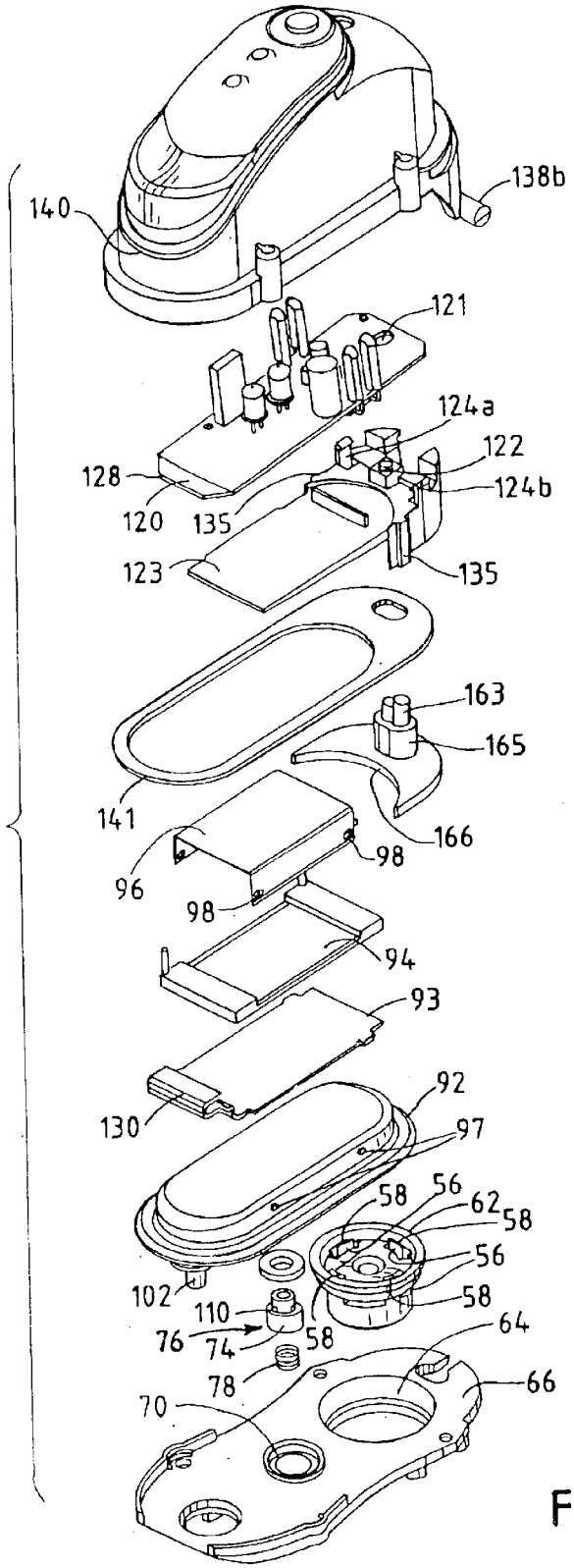
FIG. 10 is an exploded isometric view of various components of FIGS. 2–5 looking down from above.
Figure 11:
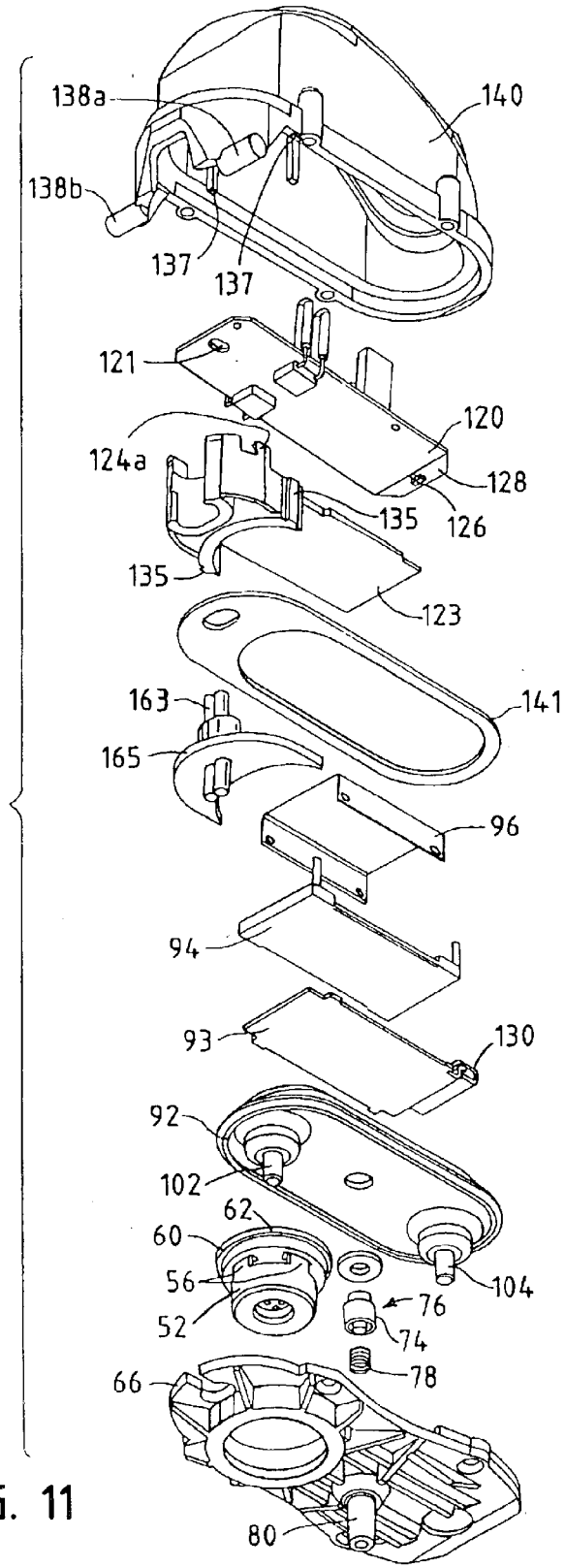
FIG. 11 is an exploded isometric view of the components of FIG. 10 looking up from below.

A printed circuit board 120 includes an aperture 121. The printed circuit board 120 is disposed on an electrically insulative carrier 123 such that a tab 122 is disposed in the aperture 121 and further such that the board 120 is engaged and restrained against movement by the tab 122 and a pair of side clips 124*a*, 124*b*. The printed circuit board 120 mounts the various electrical components shown in FIG. 7 for controlling the heater 94 including a surface-mounted temperature switch 126 (FIGS. 2, 6 and 11). With reference to FIGS. 2, 10 and 11, the temperature switch 126 is mounted at an end 128 of the printed circuit board 120 opposite the aperture 121. The distributor plate 93 includes an extension member 130 that extends outwardly and upwardly and folds back upon itself to surround the end 128 of the printed circuit board 120, and, more particularly, the temperature switch 126. A thermal compound may be provided between the distributor plate 93 and the heat exchanger 92 to enhance thermal conductivity therebetween. Preferably, the thermal compound comprises Chemplex 1381 heat sink silicone sold by NFO Technologies, a division of Century Lubricants Co. of Kansas City, Kans. A sheet of electrical insulation 131 is also provided between the extension member 130 and the temperature switch 126 to provide electrical isolation of the switch 126. The sheet 131 further extends rearwardly between the carrier 123 and the clip 96. This arrangement ensures that electrical isolation is provided for the printed circuit board 120 and further ensures that the temperature switch 126 is exposed to a temperature representative of the temperature of the heater 94.

If desired, the distributor plate 93 may be omitted and the heat exchanger 92 may be provided with an extension member like the member 130.

The mounting plate 66 is secured to an inner enclosure member 140 by any suitable means, such as screws, thereby capturing the heater assembly 90 within the member 140. In this regard, the carrier 123 includes ribs 135 (FIGS. 10 and 11) that fit within slots 137 (FIG. 11 only) of the member 140 to restrain the various components against substantial movement. A gasket 141 is provided between the heat exchanger 92 and the inner enclosure member 140 to prevent passage of material into the space above the heat exchanger 92.

Figure 13:
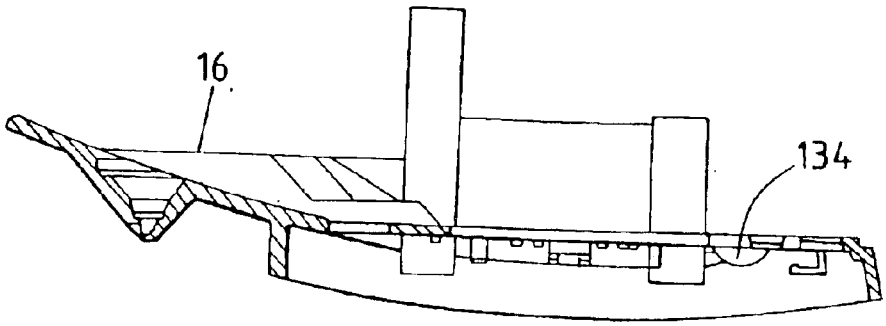
FIGS. 13 and 14 are full sectional views of the collar portion and upper portion, respectively.
Figure 14:
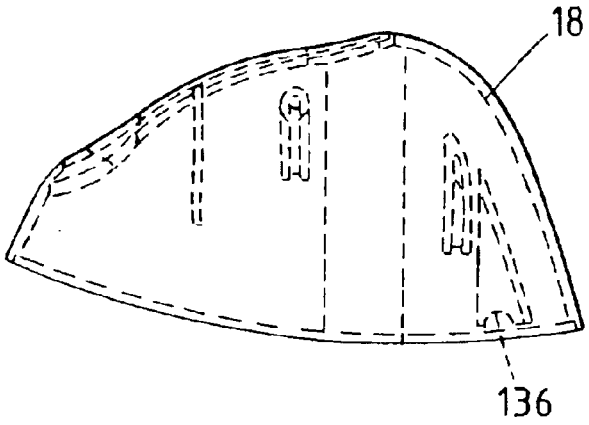

The inner enclosure member 140 is mounted for pivoting movement about a pivot axis 142 (FIG. 3) within the upper portion 18 of the housing 12 (FIG. 2). Specifically, as seen in FIGS. 13 and 14, the collar portion 16 includes a pair of semicircular recesses 134 that mate with aligned semicircular recesses 136 in the upper portion 18 to form cylindrical bores that accept a pair of axles 138*a* and 138*b* (FIGS. 3, 5, 10 and 11) of the inner enclosure member 140. The upper portion 18 of the housing 12 includes an aperture 143 (FIG. 4) through which an actuator member 144 of the inner enclosure member 140 extends. Preferably, the inner enclosure member is fabricated using a two-shot molding process wherein a main part 145 of the inner enclosure member 140 is first molded of polycarbonate and thereafter the actuator member 144 is molded onto the main part 145. Preferably, the actuator member is made of low modulus TPE. Pushing down on the actuator member 144 results in pivoting of the member 140, the heater assembly 90 and the mounting plate 66 about the pivot axis 142. This pivoting of the heater assembly 90 with respect to the upper portion 18 causes the second valve 104 to push down on walls 150 of the collar portion 16 surrounding an exit 152 (FIG. 2), thereby resulting in opening of the second valve 104 and dispensing of heated gel from the chamber 100.

Molded in the actuator member 144 is a flexible pushbutton 156 having a downwardly depending portion that is engageable with a switch SW1 (FIG. 6) carried by the printed circuit board 120. First and second lenses 160 and 162 (FIG. 3) are molded as part of the member 140 and are adapted to transmit light produced by two light-emitting diodes LED1 and LED2 (FIGS. 2, 3 and 7), respectively. Electrical power for the electrical components is supplied over a power cord 163 (FIGS. 10 and 11) that extends from the printed circuit board 120 through a bore in the gasket 141 behind the heat exchanger 92 and a power cord cover 164 and outwardly from the main body portion 14. A grommet 165 is molded as part of the power cord 163 and includes a curved surface 166 (FIG. 10) that fits against a correspondingly shaped end wall of the heat exchanger 92.

Figure 7:
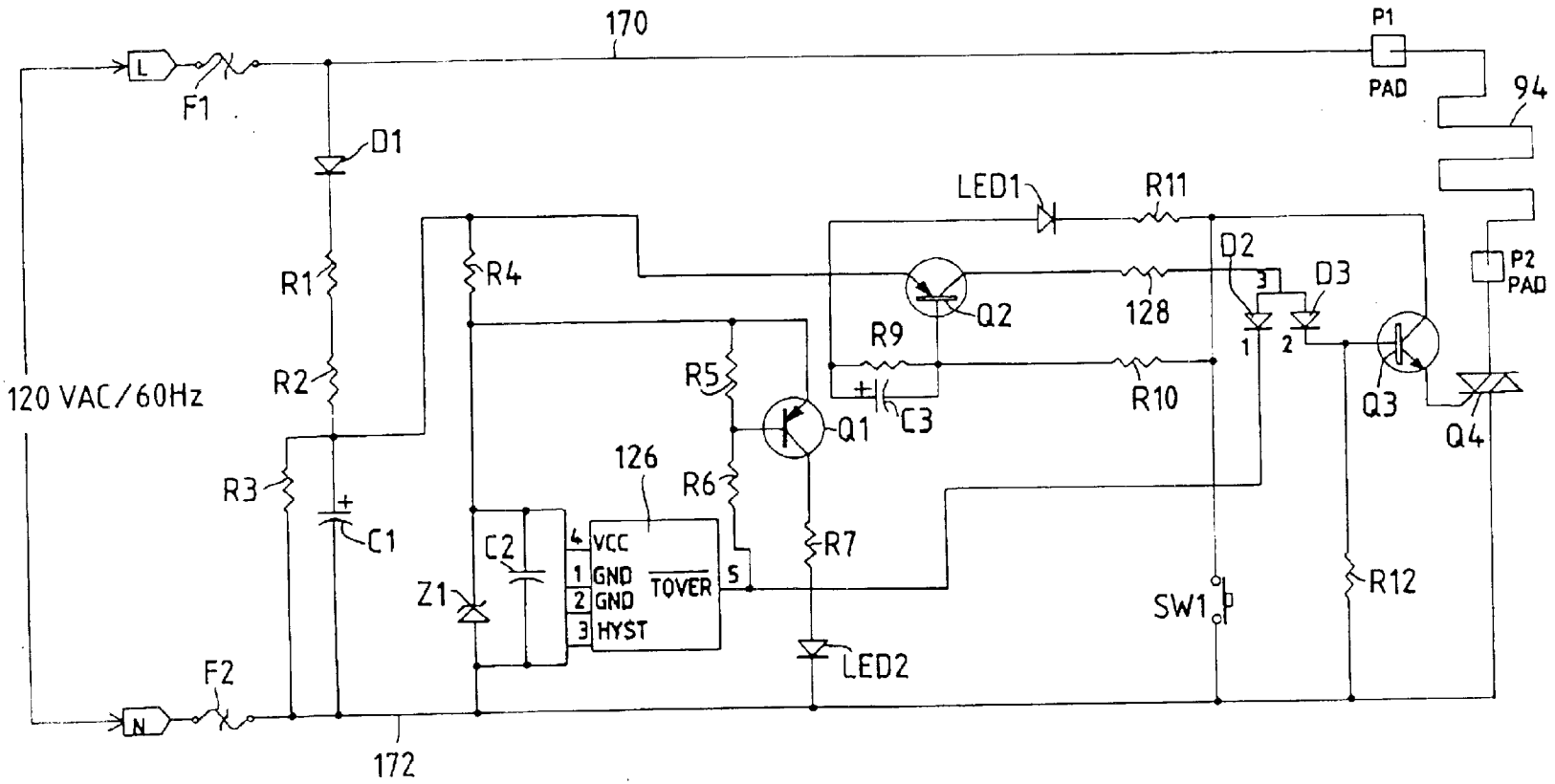
FIG. 7 is a circuit diagram of a control circuit used in the apparatus of FIGS. 1–5.

FIG. 7 illustrates the electrical circuitry for operating the heater 94. Electrical power is applied through first and second thermal fuses F1 and F2 to first and second conductors 170, 172. Resistors R1, R2 R3 and R4, diode D1, zener diode Z1 and capacitors C1 and C2 provide a stable voltage source of predetermined magnitude for the temperature switch 126. In the preferred embodiment, the temperature switch 126 comprises a MAX6501 micropower temperature switch manufactured by Maxim Integrated Products of Sunnyvale, Calif. An output of the temperature switch 126 is coupled to a transistor Q1 suitably biased by resistors R5 and R6. A resistor R7 and the diode LED2 are connected in series between the collector of the transistor Q1 and the conductor 172. The output of the temperature switch 126 is also coupled to a diode D2, which is, in turn, connected to a collector of a transistor Q2 through a resistor R8. The transistor Q2 includes an emitter coupled to a junction between the resistors R2 and R3. A resistor R9 and a capacitor C3 are connected across the base and emitter of the transistor Q2. A resistor R10 is coupled between the base of the transistor Q2 and a collector of a transistor Q3. The collector of the transistor Q3 is also coupled to the emitter of the transistor Q2 by a resistor R11 and the diode LED1.

The switch SW1 has a first end coupled to a junction between the resistors R10 and R11 and further has a second end coupled to the conductor 172. In addition, a diode D3 is connected between the resistor R8 and the base of the transistor Q3 and the latter is further coupled to the conductor 172 by a resistor R12. The emitter of the transistor Q3 is coupled to a control electrode of the triac Q4, which in turn further includes main current path electrodes connected in series with the heater 94 between the conductors 170 and 172.

INDUSTRIAL APPLICABILITY

In operation, the can of pressurized shaving gel 24 is inserted into the recess 22 until the coupling ring 36 snaps into the engaged position as noted above, thereby locking the can 24 in the recess 22. The power cord for the dispensing apparatus 10 is then plugged into a standard wall outlet (if it is not already plugged in). In this regard, the thermal fuses F1 and F2 are positioned on the printed circuit board 120 so that, in the event of a component failure causing the heater to experience a thermal runaway condition, one or both of the fuses F1 and F2 disconnects the power from the circuitry on the printed circuit board. In addition, the fuses F1 and F2 are disposed on the printed circuit board 120 proximate the resistors R1 and R2 so that, in the event that the power cord is plugged into a wall outlet supplying power at other than the 120 rated volts for the unit (such as 252 volts), the resistors R1 and R2 develop a magnitude of heat sufficient to cause one or both of the fuses F1 and F2 to disconnect the power from the balance of the circuitry on the printed circuit board 120. Of course, the fuses F1 and F2 must be rated and positioned on the printed circuit board so that a 120-volt application of power does not cause inadvertent tripping of the fuses F1 and F2.

Referring to FIGS. 2 and 6, once the power cord is plugged in the user may depress the pushbutton 156, in turn closing the switch SW1, whereupon the diode LED1 is energized by the gating of current through the diode D1, the resistors R1, R2 and R11 and the switch SW1. In addition, closing the switch SW1 turns on the transistor Q2. However, the transistor Q3 and the triac Q4 are maintained in an off condition while the switch SW1 is closed so that a user cannot cause continuous energization of the heater 94 by continuously holding down the pushbutton 156. Thereafter, upon release of the pushbutton 156, the transistor Q3 is turned on through the diode D3. In addition, upon initial closure of the switch SW1, and until the time that the temperature switch 126 detects a first temperature magnitude, such as approximately 130 degrees F., an output TOVER(bar) is in a high state. Therefore, the triac Q4 turns on and remains on to energize the heater 94 following release of the switch SW1 owing to the continued on state of the transistors Q2 and Q3 and the high state status of the output TOVER(bar). The heater 94 continues to heat until the first temperature magnitude is detected by the temperature switch 126, whereupon the output TOVER(bar) switches to a low state. Upon this occurrence, the junction between the diodes D2 and D3 is pulled low, thereby turning off the transistors Q2 and Q3 and the triac Q4 so that current flow through the heater 94 is interrupted. In addition, the transistor Q1 is turned on, thereby causing the diode LED2 to illuminate. In the preferred embodiment, the diode LED1 is red in color and the LED2 is green in color.

The dispensing apparatus 10 is designed so that the gel remains above a particular temperature (such as 125 degrees F.) for a period of time (such as 2 minutes) after heating. As should be evident from the foregoing, the temperature sensed by the switch 126 is representative of (but not exactly equal to) the temperature of the gel. Preferably, although not necessarily, the temperature sensed by the switch 126 should remain within a tolerance band of no greater than five degrees F. below the temperature of the gel. Also, the control circuit preferably controls the temperature of the gel to within ±5 degrees F. of a set point of 130 degrees F. A different set point could instead be used or a range of set points could be used, such as a range between 133 and 140 degrees F. Once the temperature switch 126 detects a temperature below a second temperature magnitude, such as approximately 125 degrees F., the output TOVER(bar) reverts to the high state, thereby turning the LED2 off. The apparatus 10 is thus in a state ready to be actuated by depressing the switch SW1 again, thereby initiating another heating sequence.

As should be evident from the foregoing, once the pushbutton 156 is depressed and released the heater 94 is energized. During this time the red LED1 is energized to alert the user that heating is occurring. This operation continues until a certain temperature is reached, whereupon the heater 94 is deenergized and the red LED1 is turned off and the green LED2 is turned on. The green LED2 remains in the energized state informing the user that the gel is ready for dispensing until the temperature sensed by the temperature switch 126 drops below the second temperature magnitude. Significantly, the heater 94 remains deenergized until the pushbutton 156 is again depressed, thereby providing an auto-shutoff feature that contributes to the safety of the apparatus 10.

Because the heater 94 heats the heat exchanger 92 and the gel through the distributor plate 93, the heat exchanger 92 and the gel contained therein cannot be heated to a temperature higher than the distributor plate 93. Also, inasmuch as the temperature switch 126 is closely thermally coupled to the distributor plate 93, the temperature of the plate 93 is accurately controlled, and the relatively high thermal mass of the plate 93 results in accurate tracking of the gel temperature with the temperature of the plate 93 with only short time lags. Accuracy is further enhanced by the isolation of the temperature switch 126 from the surrounding environment (except for the temperature of the plate 93). This is achieved by disposing the temperature switch 126 at an end of the printed circuit board 120 remote from the balance of the circuitry carried by the board 120 and providing serpentine electrical connections to the temperature switch 126. Further thermal isolation is accomplished by surrounding the temperature switch 126 with the extension member 130. Still further accuracy is afforded by the use of the temperature switch 126 itself, inasmuch as such device has a low thermal mass that does not require significant energy to heat or cool.

It should be noted that the dispensing apparatus 10 is compact yet capable of accommodating various can sizes. This ability is at least partially afforded by the size of the recess 22 and the positive locking of the can 24 therein by the coupling ring 36. In the preferred embodiment, a wide range of can sizes can be accommodated, such as cans between 0.50 inch and 4.00 inches in diameter and 1.00 inch and 8.00 inches in height, although any can size could be used provided that the dispensing apparatus 10 is appropriately designed to accept such can size.

The present invention comprehends a shave gel heating system that minimizes post-foaming of the gel prior to dispensing thereof. This is achieved by using a post foaming component in the gel formulation (preferably isopentane alone without isobutane) that exhibits a relatively low vapor pressure (as compared with gel formulations not intended to be heated) and by employing a closed heating system that keeps the heated gel under can pressure until the gel is dispensed.

It should be noted that the present invention may be modified by omitting the valve 102, in which case suitable sealing apparatus evident to one of ordinary skill in the art would be provided between the can valve 32 and the heat exchanger to allow the gel in the heat exchanger to be maintained at can pressure.

FIGS. 16 through 26 illustrate another embodiment according to the present invention wherein many of the features of the embodiment are similar in structure and function to the embodiments described above. As before, elements common to the various embodiments are given like reference numerals.

Figure 17:
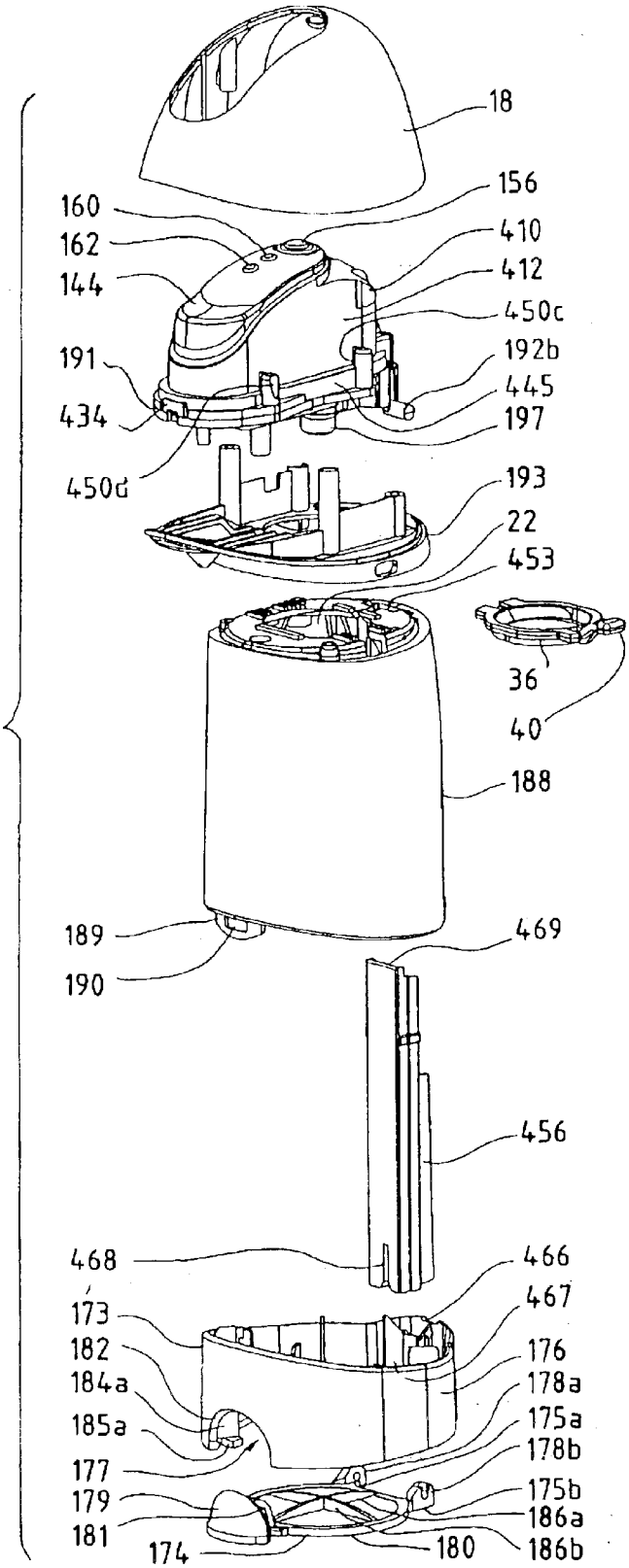
FIG. 17 is an exploded isometric view of various components of FIG. 16.
Figure 18:
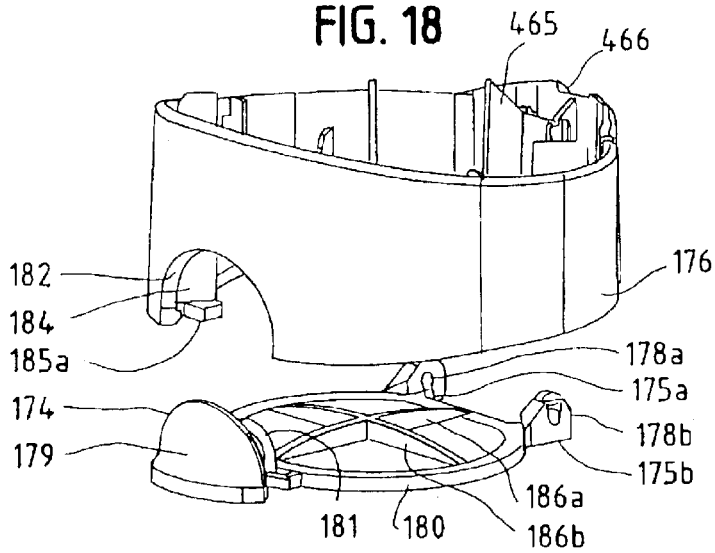
FIG. 18 is an exploded and enlarged isometric view of a portion of the apparatus of FIG. 17.
Figure 18A:
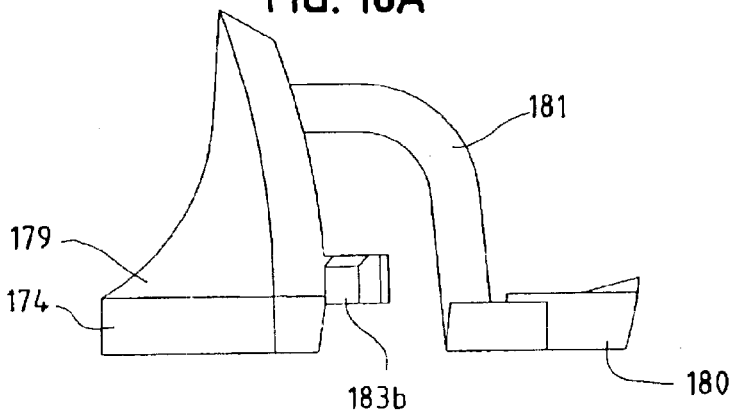
FIG. 18A is an enlarged, fragmentary elevational view of a portion of FIG. 18.
Figure 18B:
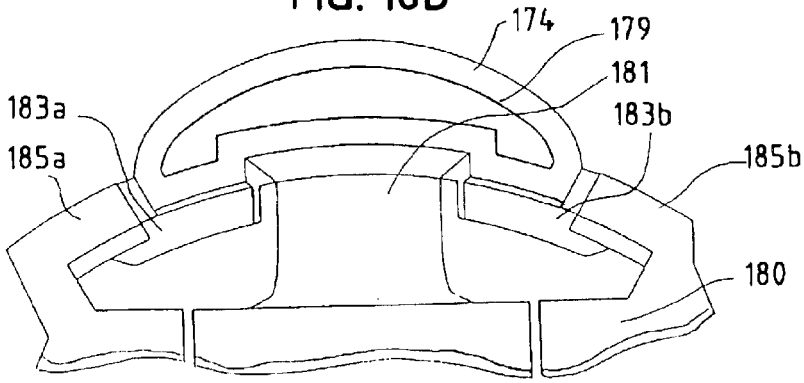
FIG. 18B is an enlarged, fragmentary bottom view of the apparatus of FIG. 18A.

In the embodiment of FIGS. 16 through 26, the base portion 20 is replaced by a base portion 173 having a door 174. Referring to FIG. 17, the door 174 includes first and second hinge members 175*a*, and 175*b*. First and second hinge pins (not shown) are disposed on a lower part 176 of the base portion 173 adjacent a door opening 177 and fit within first and second bores 178*a*, and 178*b* extending through the hinge members 175*a*, 175*b* such that the door 174 is retained on the base portion 173, but is able to pivot about the hinge pins. The door 174 further includes a lip 179 that a user may push down upon to open the door 174. Referring to FIGS. 18, 18A and 18B, the lip 179 is coupled to a main portion 180 of the door 174 by a flexible curved member 181 that permits the lip 179 to be deflected and inserted into an opening 182 so that flanges 183*a* and 183*b* disposed on either side of the lip 179 may be snapped inside first and second recesses 184 (one of which is visible in FIG. 18) disposed above further flanges 185*a* and 185*b*. The door 174 may be used to push the can 24 into the recess 22. Upstanding walls 186*a* and 186*b* engage a bottom rim (not shown) of the can 24 and slide thereon during installation of the can 24 into the recess 22.

Referring again to FIG. 17, a main body portion 188 replaces the portion 14 of the embodiment described above. The portion 188 includes a tab 189 having an opening 190 therein that receives a further tab (not shown) disposed on the interior wall of the base portion 173 for further securing the base portion 173 to the main body portion 188. The portion 188 is otherwise identical to the portion 14.

Figure 19:
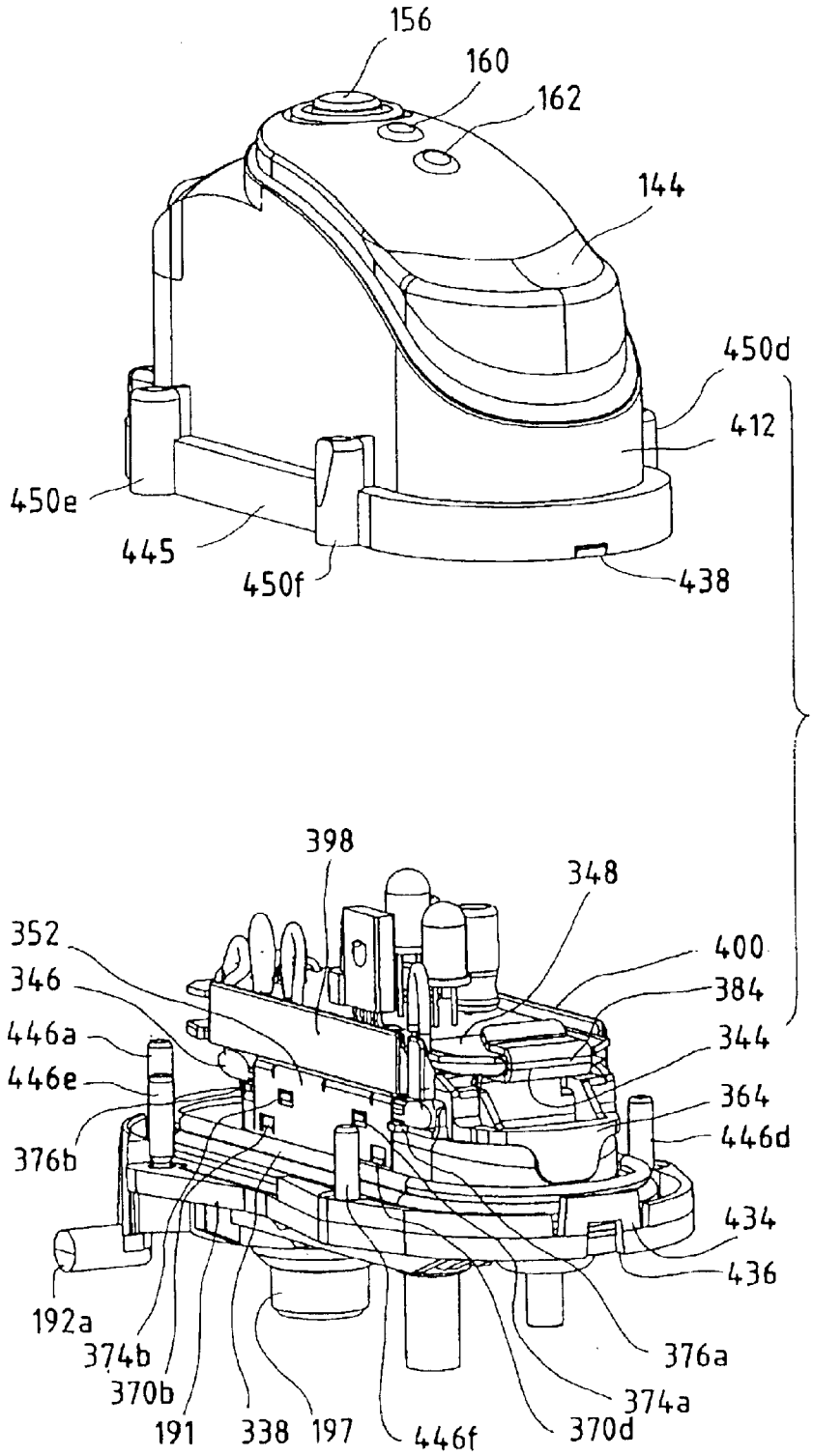
FIG. 19 is an exploded and enlarged isometric view of components of FIG. 17.
Figure 20:
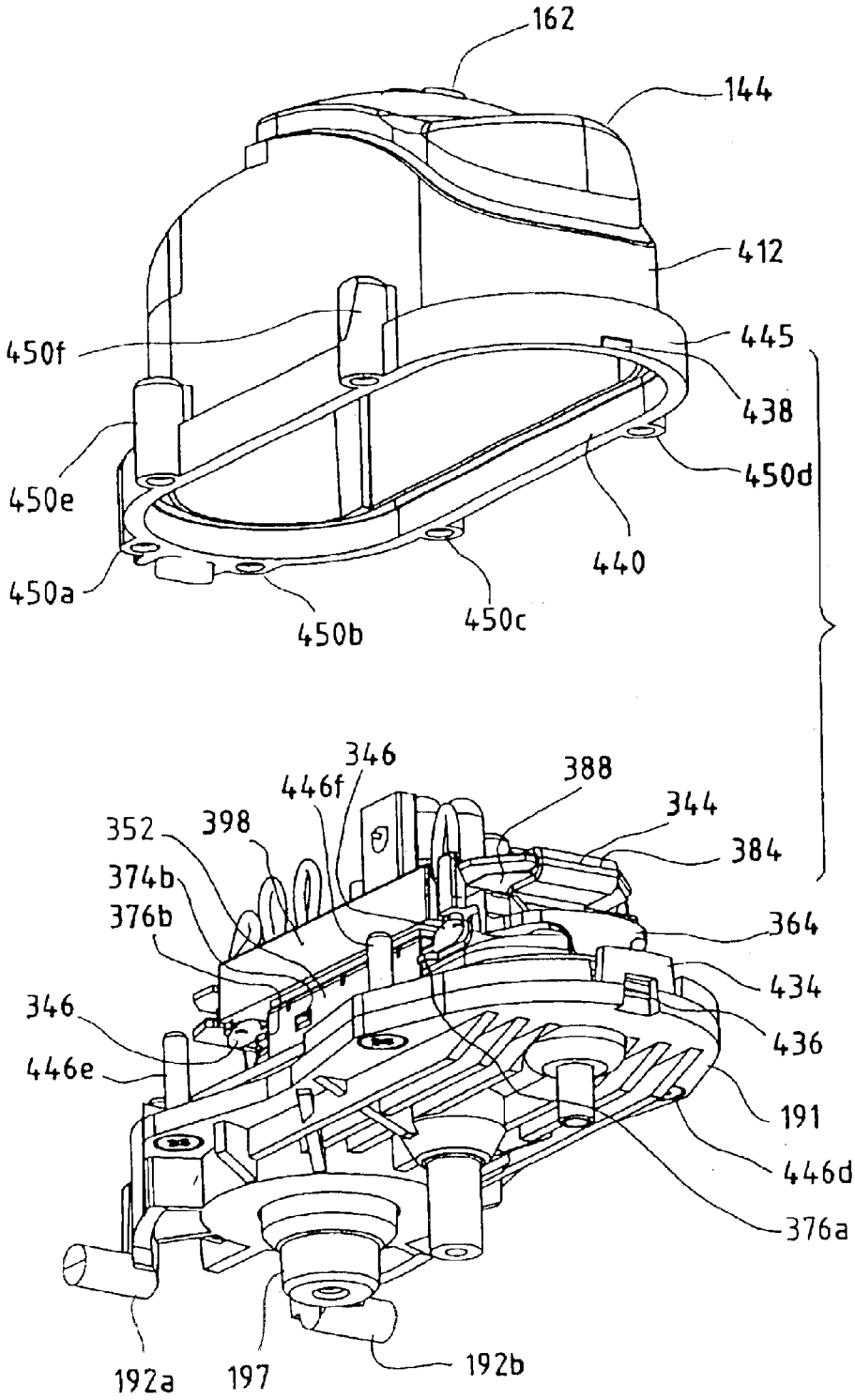
FIG. 20 is an exploded isometric view of the apparatus of FIG. 19 looking up from below.
Figure 21:
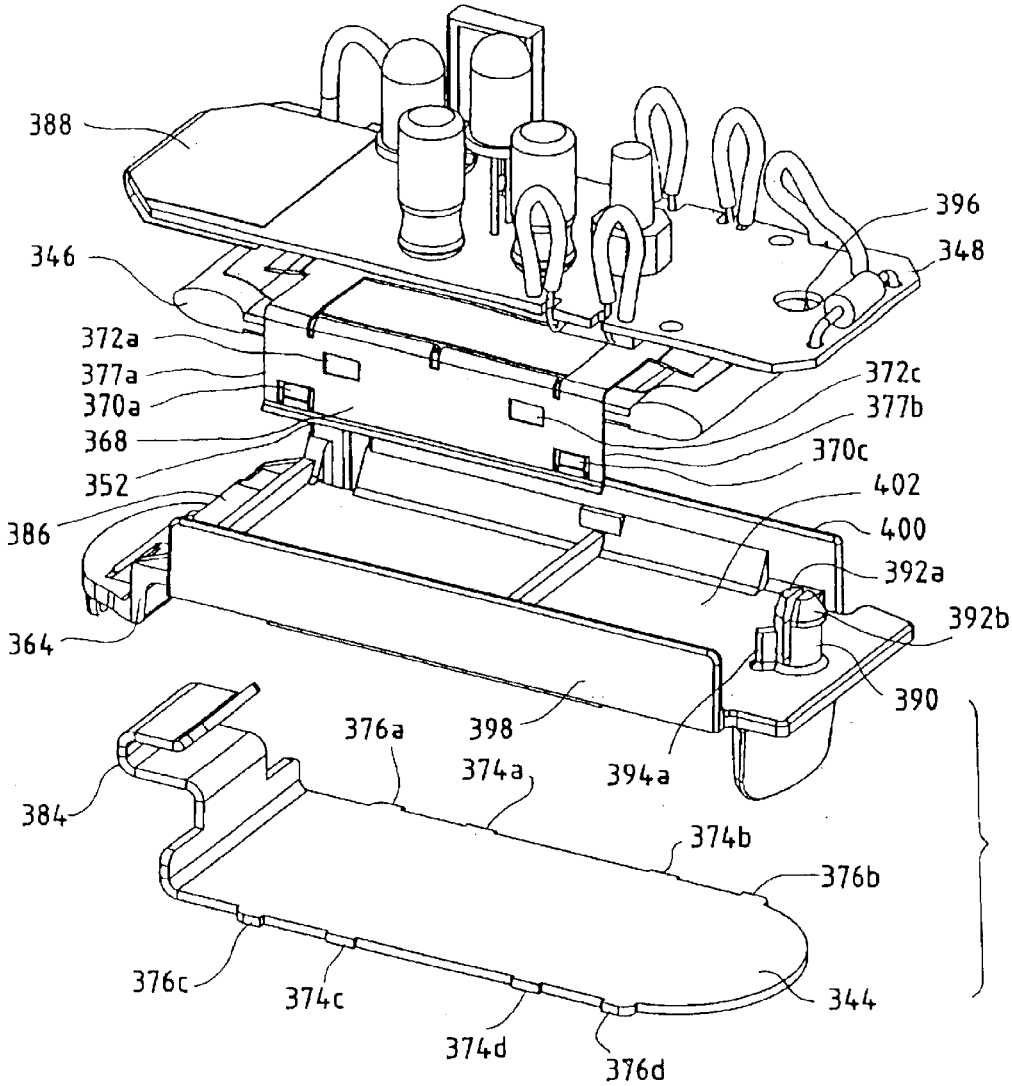
FIG. 21 is an exploded, enlarged, fragmentary isometric view of the components of FIG. 19.

Referring to FIGS. 19 and 20, the mounting plate 66 described above is replaced by a mounting plate 191 wherein the plate 191 includes first and second axles 192*a*, and 192*b* that perform in like manner to the axles 137*a*, 137*b*. The axles 192*a*, 192*b* fit within aligned recesses (not shown in FIGS. 16–26 but identical to the recesses 136 of FIG. 14) disposed in the upper portion 18 and in aligned recesses (not shown) disposed in a collar portion 193 (FIG. 17) wherein the portion 193 is substantially identical to the collar portion 16 but which may have portions of slightly different shape to accommodate newly introduced components of the present embodiment.

Figure 22:
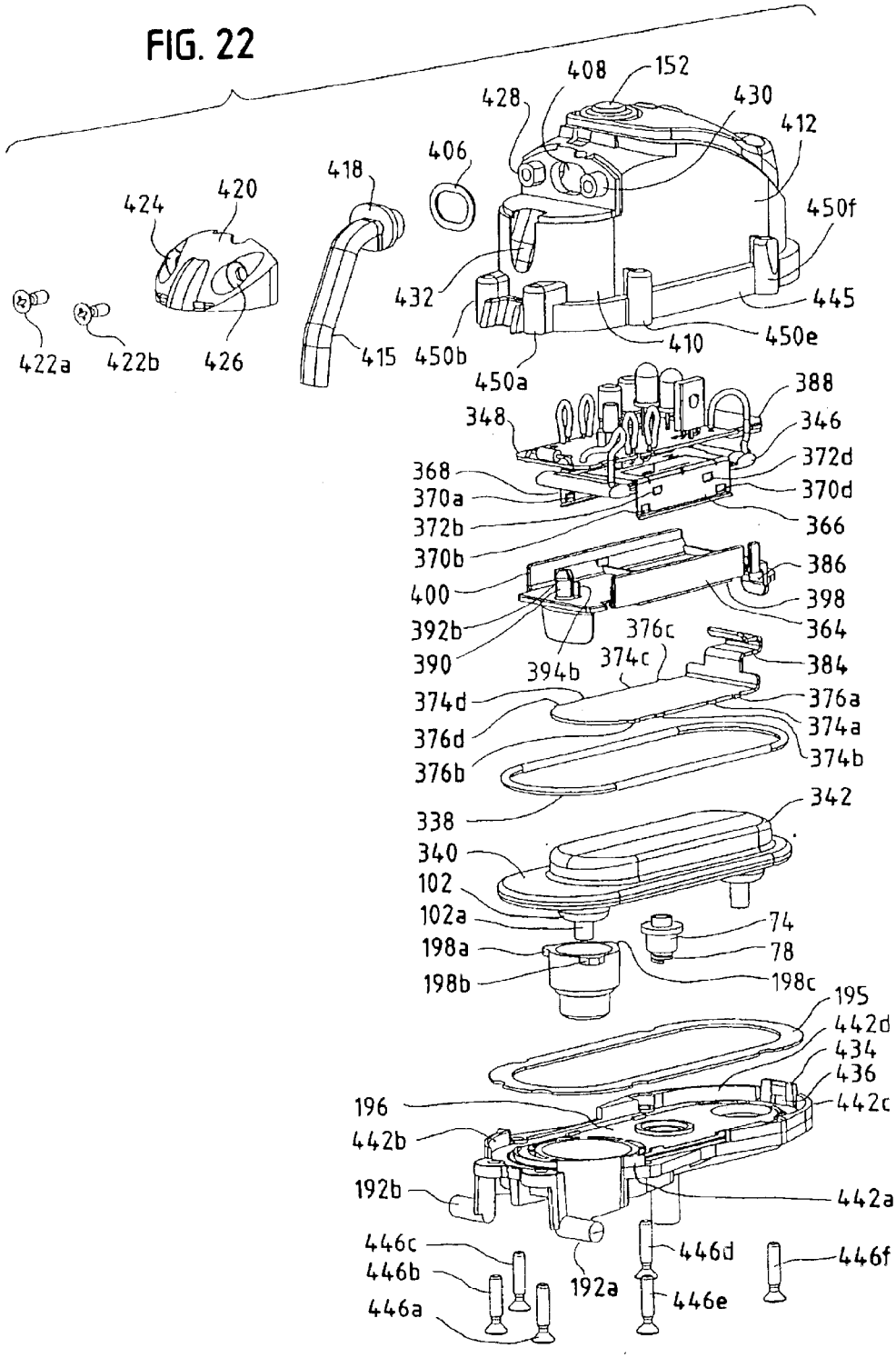
FIG. 22 is an exploded isometric view of the components of FIG. 19 looking down from the rear and above.
Figure 23:
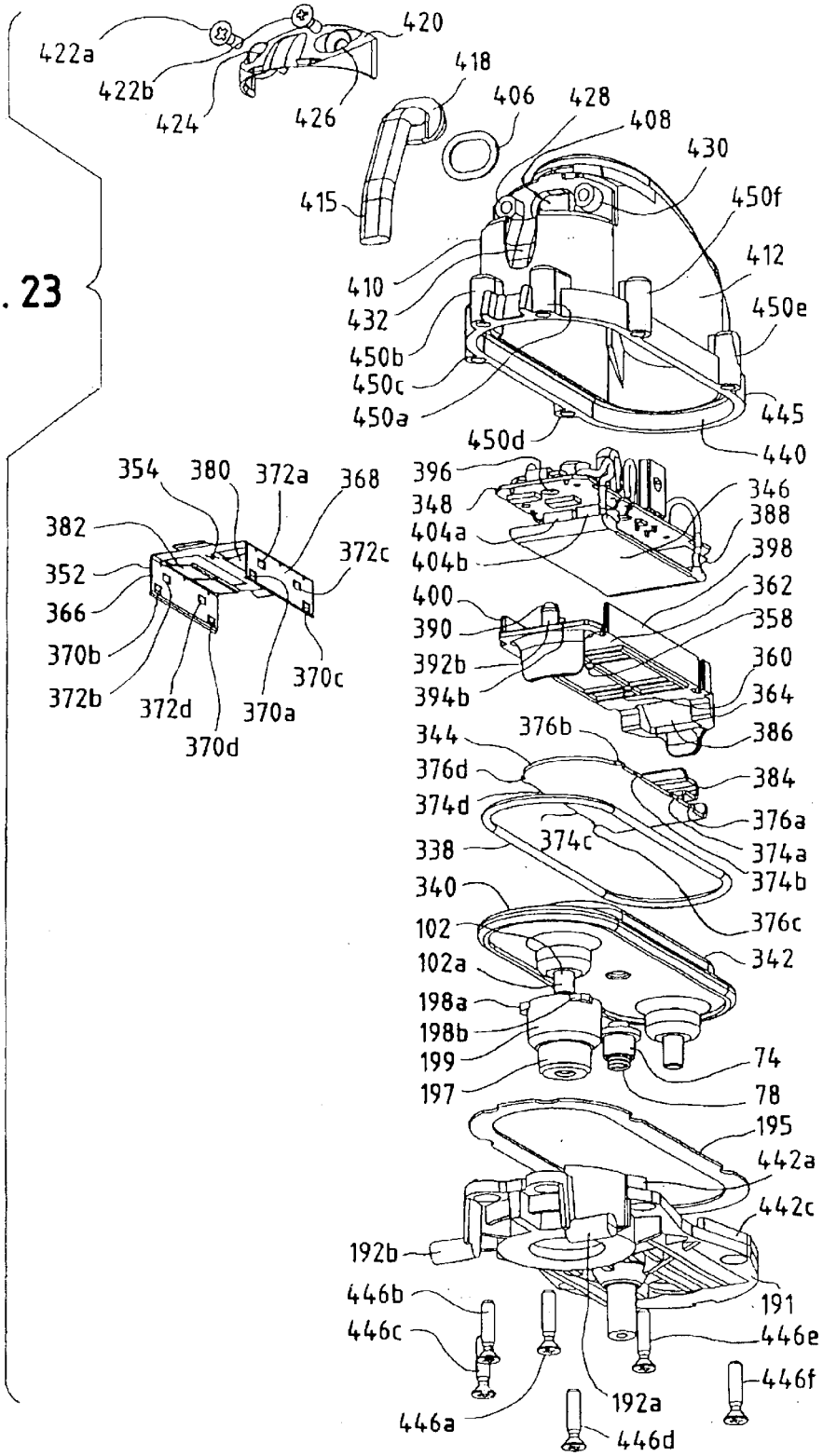
FIG. 23 is an exploded isometric view of the apparatus of FIG. 19 looking up from the rear and below.
Figure 24:
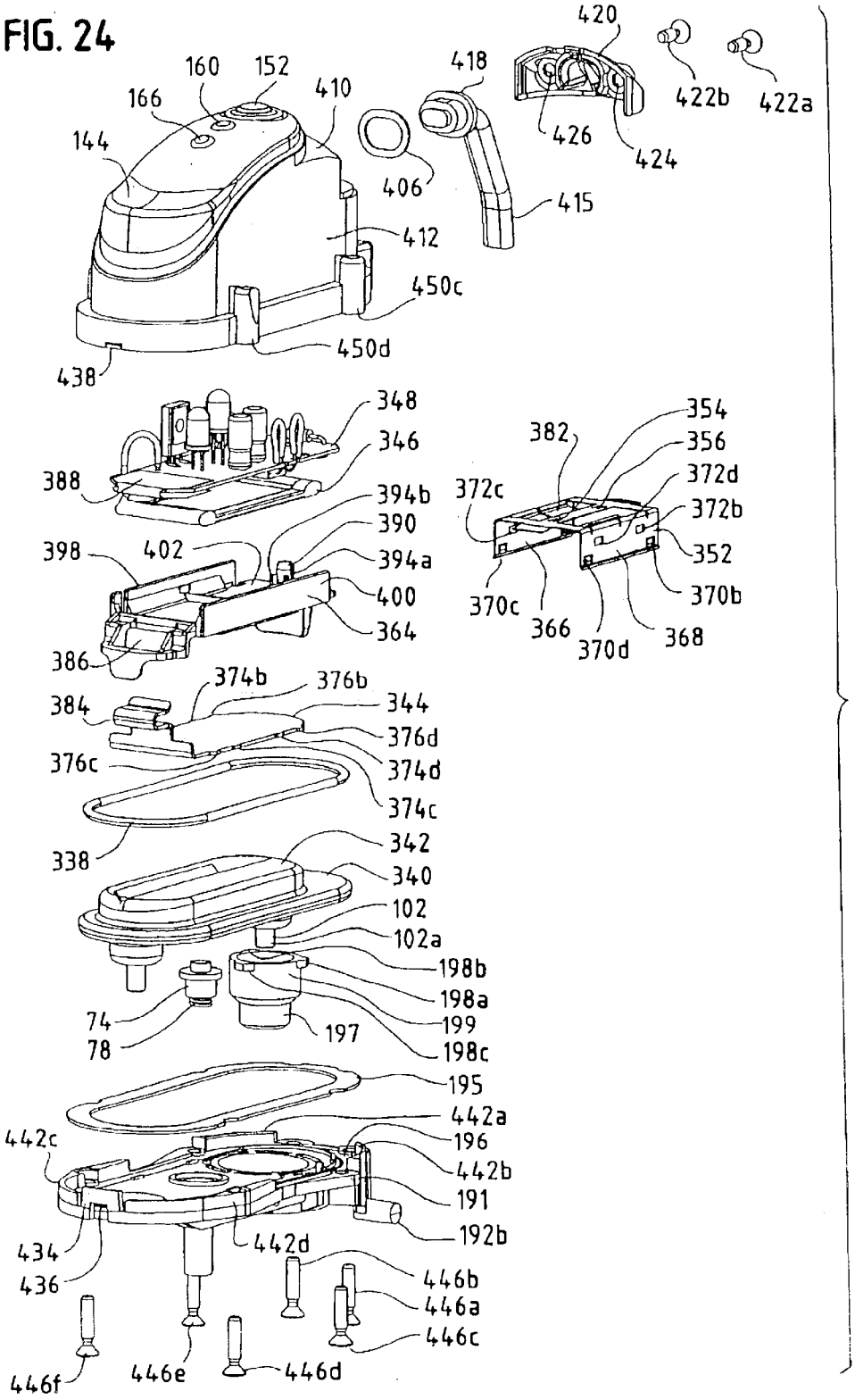
FIG. 24 is an exploded isometric view of the apparatus of FIGS. 22 and 23 looking down from the front and above.

Referring to FIGS. 22–24, a gasket 195 is adhered by a suitable adhesive to a surface 196 of the mounting plate 191. A coupling cover 197, similar in some respects to the covers 52 and 52*a*, includes three flange members 198*a*–198*c* extending radially outwardly from an upper periphery 199 of the cover 197. The members 198 are movable into abutment with a circumferential shouldered portion 200 (seen in FIG. 25) of a stepped counterbore 201 wherein the counterbore 201 is identical to the counterbore 64 of the embodiments illustrated in FIGS. 3–5.

Figure 25:
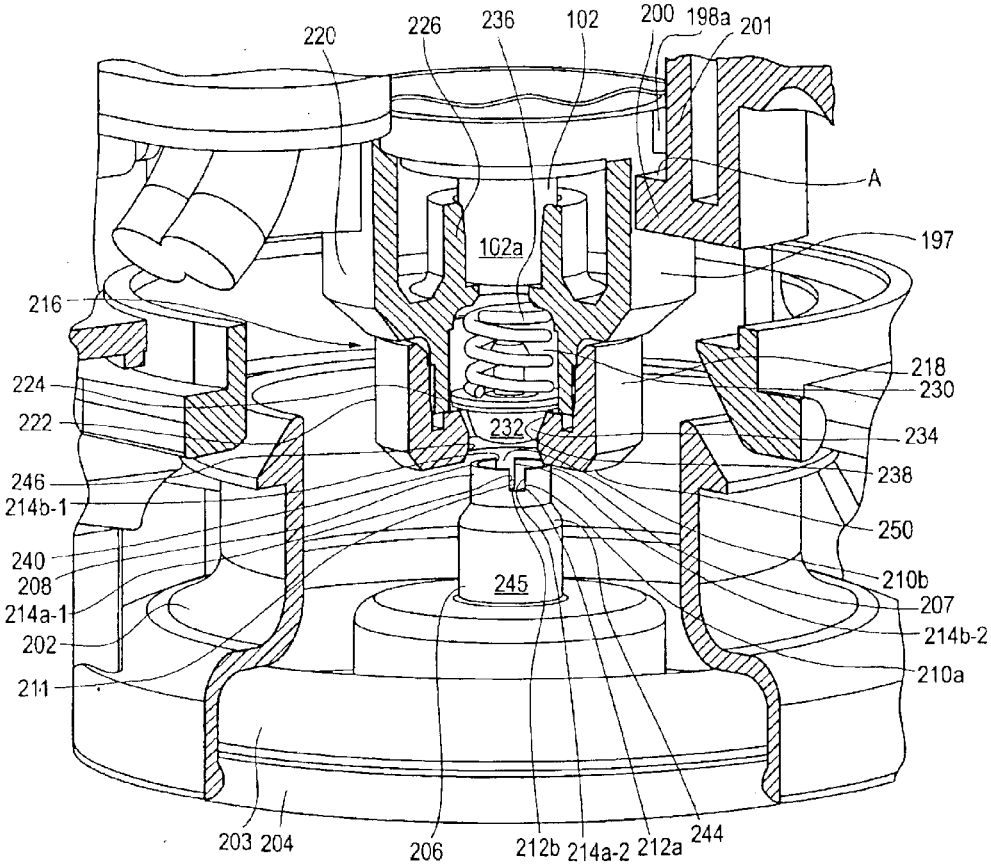
FIGS. 25 and 26 are isometric views, partly in section, of another embodiment of the present invention, illustrating a container valve in disengaged and engaged positions, respectively, with respect to a dispenser valve.
Figure 25A:
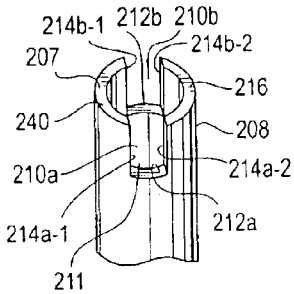
FIG. 25A is an enlarged fragmentary isometric view of a portion of the valve stem illustrated in FIGS. 16 and 17.
Figure 26:
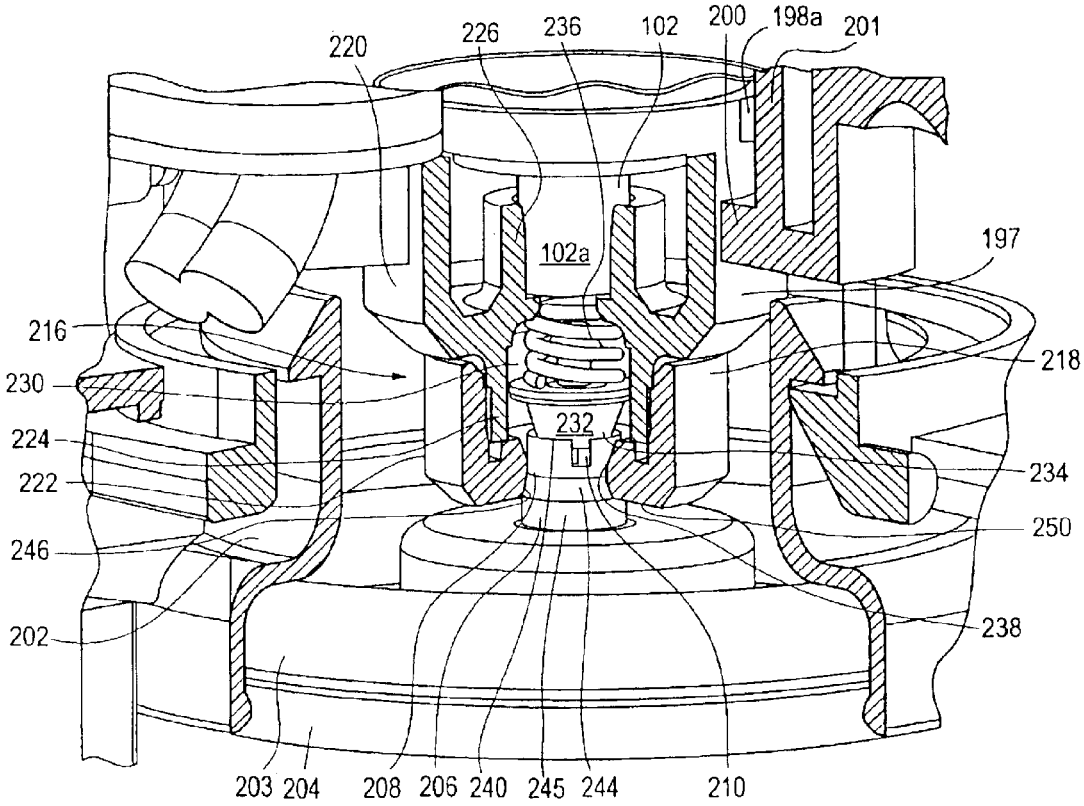

Referring next to FIGS. 25 and 26, the coupling cap 26 is replaced by a coupling cap 202 that is securely mounted on an annular rim 203 of a container 204 and which is engaged by the coupling ring 36 to retain the container 204 in the recess 22 as noted above. The container 204 further includes a male-type container valve having a hollow valve stem 206 wherein the valve stem 206 has a profiled end surface 207 disposed at the end of a reduced diameter tip portion or exterior end 208. The exterior end 208 of the valve stem 206 further includes at least one side opening 210. More specifically, referring also to FIG. 25A, a slot 211 is formed in the exterior end 208 and defines first and second side openings 210*a*, 210*b*. Each of the side openings 210*a*, 210*b* includes a base surface 212*a*, 212*b*, respectively, and side surfaces 214*a*-1, 214*a*-2 and 214*b*-1, 214*b*-2, respectively. In the illustrated embodiment, the side surfaces 214*a*-1 and 214*a*-2 are substantially perpendicular to the base surface 212*a* and the side surfaces 214*b*-1 and 214*b*-2 are substantially perpendicular to the base surface 212*b*.

The coupling cover 197 forms a part of a dispenser inlet valve 216 and includes a movable collar assembly 218 comprising a valve coupling member 220 and a first sealing element in the form of a can coupling member 222. The members 220 and 222 are preferably made of a thermoplastic, such as acetal N2320 natural manufactured by BASF Corporation. The can coupling member 222 is secured to a first cylindrical wall 224 of the valve coupling member 220 in any suitable fashion, such as by sonic shear welding. The valve coupling member 220 further includes a second cylindrical wall 226 that is sealingly engaged with a valve stem 102*a* of the first valve 102. Alternatively, the first valve 102 may be omitted and replaced by a hollow tube disposed in fluid communication with the chamber 100 of the heat exchanger 92, in which case the collar assembly 218 need not be movable. In either event, the collar assembly 218 is hollow and includes an interior chamber 230 therein within which is disposed a movable second sealing element 232. The movable second sealing element 232 is preferably made of a polymer (such as CELCON® M90, manufactured by Ticona of Summit, N.J. 07901) and has a substantially spherical sealing surface 234 that is urged by a spring 236 against an inner surface of the can coupling member 222 defining a valve seat 238. The material of the spring 236 is preferably stainless steel and the spring is preferably of the conical type to provide a centering action for the element 232.

As the container 204 is inserted into the recess 22, the container is guided by the walls defining the recess 22 into the position shown in FIG. 25. Eventually, an end surface 240 of the exterior end 208 contacts the spherical sealing surface 234. Continued advancement of the container 204 into the recess 22 causes the exterior end 208 of the stem 206 to displace the movable second sealing element 232 upwardly against the force exerted by the spring 236 until the container 204 reaches the position shown in FIG. 26. At this point, the coupling ring 36 moves to the engaged position interfering with the coupling cap 200 to lock the container 204 in position as noted above in connection with the previous embodiment. The stem 206 includes a tapered surface 244 of a main body portion 245 that seats against a tapered surface 246 of the can coupling member 222. Preferably, the tapered surface 246 forms an included angle relative to a horizontal line in FIGS. 25 and 26 which is 1–2 degrees less than the included angle between the tapered surface 244 and a horizontal line. Thus, as the container 204 is pushed upwardly and the force exerted by the spring 236 is overcome, the tapered surface 244 seals against the tapered surface 246. In addition, the pressure exerted on the exterior end 208 causes the collar assembly 218 to move upwardly to open the first valve 102 (if the collar assembly 218 is movable and the first valve 102 is used). Also, the container valve is opened. The sealing of the tapered surface 244 against the tapered surface 246 prevents gel from escaping outside of the chamber 230. The escaping gel flows out of the side openings 210*a*, 210*b*, around the movable second sealing element 232 and into the chamber 100 of the heat exchanger 92 via the valve 102 or the hollow tube described above. Thereafter, the gel is heated and dispensed as noted above without substantial foaming.

When the container 204 is to be removed from the recess 22, the coupling ring 36 is moved away from the engaged position as noted above, thereby allowing the spring 236 and the resilient valve 102(if used) and the container valve to forcibly eject the container 204 from the recess 22. At this time, the container valve closes and the movable second sealing element 232 moves to a closed position whereby the spherical sealing surface 234 is sealed against the valve seat 238, thus preventing the escape of gel from the chamber 230.

The arrangement illustrated in FIGS. 25 and 26 prevents a conventional pressurized container having a valve that does not utilize a reduced tip diameter and one or more side exits from being used in the dispensing apparatus. Specifically, any attempt to use a container having a conventional valve stem will result in engagement of the end of the valve stem with a bottom surface 250 of the can coupling member 222 without any upward displacement of the spherical sealing surface 234 away from the valve seat 238. The bottom surface 250 may also include spaced tabs (not shown) that would prevent a conventional valve stem from making sealing engagement with the surface 250. The stiffness of the spring 236 is preferably selected to provide a spring force sufficient to prevent substantial opening of the dispenser inlet valve 216 even if the spherical sealing surface 234 were exposed to pressurized contents of a container having a conventional valve stem. Hence, even if sufficient upward pressure were exerted to cause product to be expelled from such a container, the product either would not enter the chamber 230 (and therefore, the chamber 100 of the heat exchanger), or the product would be dispensed at such a low flow rate that the use of the dispenser would be impractical.

If a container having a reduced diameter tip is used wherein the tip does not include at least one side exit, the tip may be capable of being inserted into the can coupling member 222 to displace the spherical sealing surface 234 away from the valve seat 238. However, as noted above, the spring force exerted by the spring 236 is preferably sufficient to keep the spherical sealing surface 234 in tight sealing engagement with the end of the container tip so that escape of product from the container is prevented. In this fashion, a container that stores a material that should not be heated or which uses a non-conforming container valve cannot be used with the dispensing apparatus.

It should be noted that the present invention is not limited to post-foaming gels, but instead may comprise another personal care or non-personal care product that is to be heated and/or dispensed, such as a lotion, a pre-shave product, a soap or detergent, a lubricating jelly, a food product, an industrial product, etc.

The dispenser inlet valve 216 provides anti-clogging benefits. Specifically, after the introduction of post-foaming gel into the chamber 230 and withdrawal of the container from the recess 22, the spherical sealing surface 234 reseals against the valve seat 238, thereby minimizing the exposure of the gel in the chamber 230 to ambient conditions. Post-foaming of the gel in the chamber 230 is thus minimized. In addition, subsequent movement of the spherical sealing surface 234 away from the valve seat 238 during insertion of a new container into the recess 22 allows dried gel and/or foam particles to be flushed away from the surfaces of the spherical sealing surface 234 and the valve seat 238.

Figure 27:
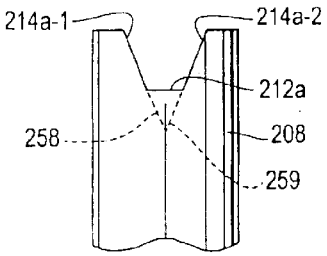
FIGS. 27–29 are fragmentary elevational views of alternate container valve stem tip portions that may be used in the embodiment of FIGS. 25 and 26.
Figure 28:
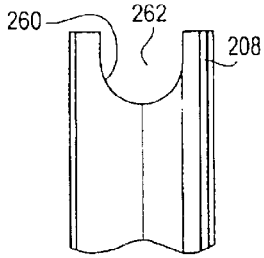
Figure 29:
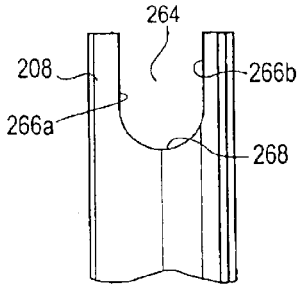

A number of alternate embodiments can be envisioned. For example, FIGS. 27–29 illustrate different configurations for the reduced diameter exterior end 208. The embodiment of FIG. 27 is identical to the embodiment of FIG. 25, except that the side surfaces 214 (e. g., 214*a*-1 and 214*a*-2) are disposed at angles other than 90 degrees with respect to the corresponding base surface 212 (e. g., the base surface 212*a*). In an alternate embodiment, the base surface is omitted and the side surfaces 214 are extended downwardly (as shown by the dotted lines 258 and 259 of FIG. 27) to form a V-shaped opening.

Also, if desired, the straight line segments defining the side surfaces 214 and/or the base surface 212 may be replaced by continuous curved line segments or discontinuous straight or curved line segments. Thus, for example, the embodiment of FIG. 28 includes a single continuous curve 260 defining each side opening 262 (of which there may be one or more.) FIG. 29 illustrates an embodiment wherein a side opening 264 is defined by straight-line side segments 266*a*, 266*b* and a continuous curved base segment 268.

Figure 30:
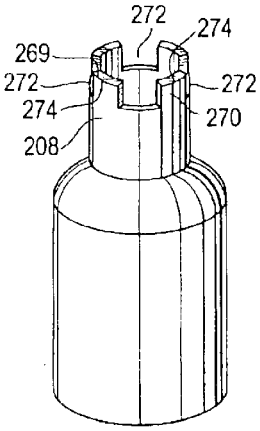
FIGS. 30–32 are isometric views of still other alternate container valve stem tip portions that may be used in the embodiment of FIGS. 25 and 26.
Figure 31:
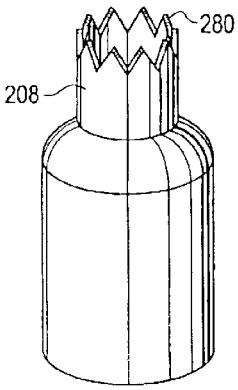
Figure 32:
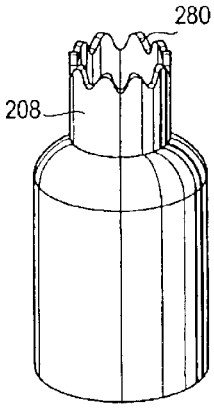

FIGS. 30–32 illustrate embodiments wherein the exterior end 208 includes a profiled end surface defining a section of a particular shape. Specifically, FIG. 30 illustrates an embodiment wherein the exterior end 208 includes an end surface 269 defining a crenellated portion 270 including at least one (and, preferably, more than one) groove 272 and land(s) 274.

FIGS. 31 and 32 illustrate embodiments wherein an end surface 280 defines sections of zig-zag and sinusoidal shape, respectively. Other profiled end surfaces could be envisioned, such as surfaces having a dovetail or scallop shape, or combination of shapes, the only requirement being that at least one side opening is provided to allow escape of product therethrough.

Figure 33:
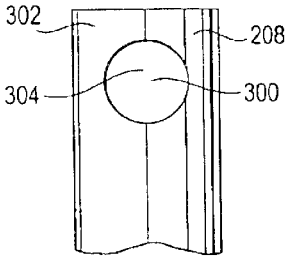
FIGS. 33 and 34 are fragmentary elevational views of still further alternate container valve stem tip portions that may be used in the embodiment of FIGS. 25 and 26.
Figure 34:
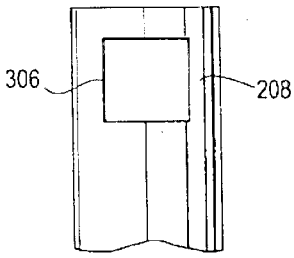

FIGS. 33 and 34 illustrate embodiments wherein the at least one side opening is defined by at least one wall substantially completely surrounding the opening. Thus, for example, a side opening 300 of FIG. 33 is defined by portions of a wall 302 of the exterior end 208 surrounding a circular aperture 304. FIG. 34 illustrates an embodiment identical to FIG. 33 except that the aperture 304 is replaced by an aperture 306 that is rectangular, square or otherwise non-circular. Other aperture shapes may alternatively be utilized, such as a chevron shape, a semicircle, an oval, a cross, a T-shape, etc.

Figure 35:
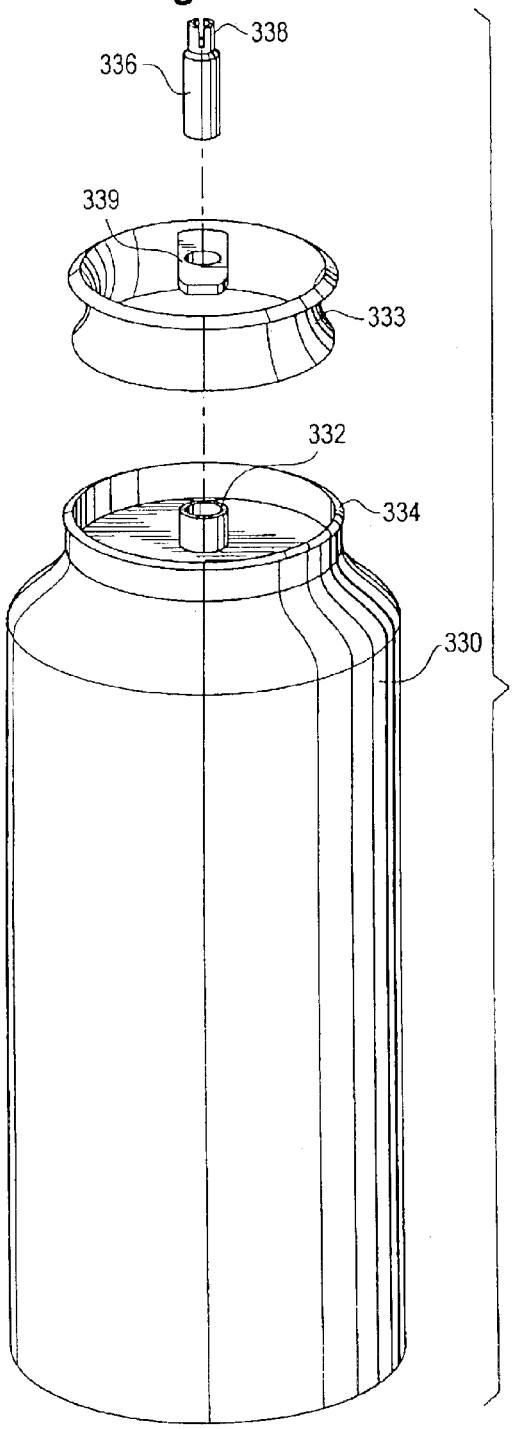
FIG. 35 is an exploded isometric view of yet another embodiment of the present invention.
Figure 36:
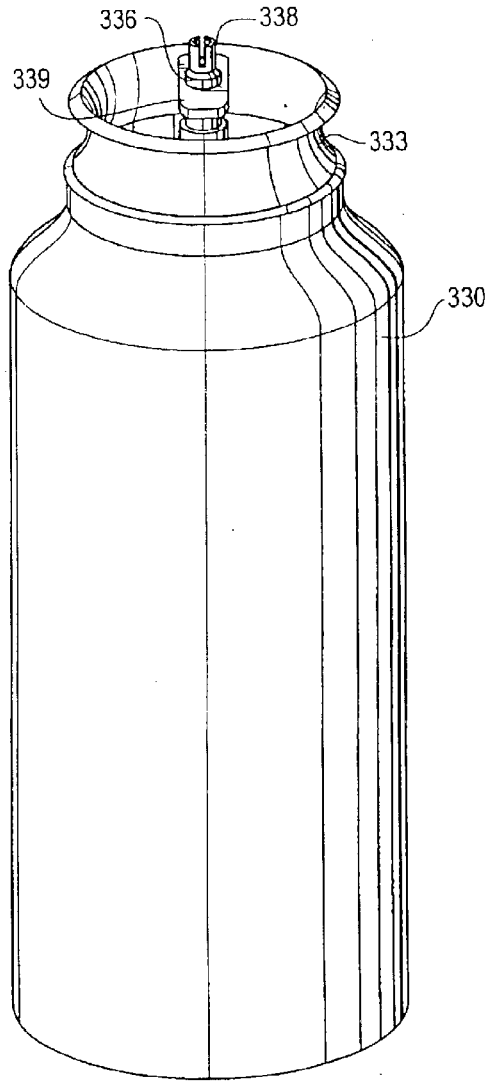
FIG. 36 is an isometric view of the embodiment of FIG. 35 in assembled form.

FIGS. 35 and 36 illustrate yet another embodiment wherein a container 330 that stores a pressurized material includes a female aerosol valve (not shown, but disposed within the container 330) wherein the valve is disposed in fluid communication with an opening 332. A coupling cap 333 similar or identical to the coupling cap 200 is mounted on an annular rim 334 of the container 330, as in the embodiment of FIGS. 25 and 26. In addition, a hollow stem 336 is disposed in the opening 332. The hollow stem 336 includes an exterior end 338 identical to the exterior end 208 of any of the embodiments described above. If desired, the hollow stem 336 may extend through and be supported by one or more fingers or webs of material of the coupling cap 200, for example, as shown by the finger 339. Alternatively, the stem 336 may be integral with the finger(s) or web(s) of such material or may not be supported by any structure whatsoever. The resulting assembly may be used in the dispensing apparatus in the fashion described above.

Referring again to FIGS. 22–24, a heat resistant O-ring 338 abuts an outer perimeter 340 of a heat exchanger 342 (seen in FIG. 19) that is substantially identical to the heat exchanger 92 but has a slightly altered shape to accommodate newly introduced features of the present embodiment. A heat distributor plate 344, which is similar to the distributor plate 93, sits atop the heat exchanger 342. As noted above, a thermal compound may be provided between the distributor plate 344 and the heat exchanger 342 to enhance thermal conductivity therebetween. An electrical resistance heater plate 346 is disposed atop the distributor plate 344 wherein the heater plate 346 is electrically coupled to a printed electrical circuit board 348. The circuit board 348 is similar to the board 120 but the board 348 may include only one thermal fuse as opposed to the two thermal fuses described above. The board 348 may be otherwise identical to the board 120. (In FIGS. 22–24 the heater plate 346 is shown coupled to the circuit board 348, but may be assembled between the components shown in FIGS. 22–24 before connection to the circuit board 348. The relative position of the various components when assembled is best illustrated in FIG. 19.)

A retainer clip 352 is disposed atop the heater plate 346. The heater plate 346 is, in turn, disposed atop the distributor plate 344. The clip 352 surrounds the plates 346, 344 and maintains such plates in assembled relationship. First and second apertures 354, 356 of the clip 352 receive first and second tabs 358, 360 (seen in FIG. 23) disposed on an underside 362 of a carrier 364. Sidewall members defining the apertures 354, 356 engage the tabs 358, 360 to secure the carrier 364 to the clip 352. The clip 352 is made of like material as the clip 96 (discussed above) and is sufficiently flexible to allow first and second sidewalls 366, 368 thereof to deform and snap over sidewalls of the heat exchanger 342 such that first through resiliently biased flap members 370*a*–370*d* press against the sidewalls of the heat exchanger 342 to retain the clip 352 thereon. Once installed, upper apertures 372*a*–372*d* in the sidewalls 366, 368 receive first through fourth inner tabs 374*a*–374*d* disposed about the periphery of the distributor plate 344. The distributor plate 344 further includes first through fourth outer tabs 376*a*–376*d* that abut first and second edges 377*a* and 377*b* of the sidewalls 366, 368 to accurately position the clip 352 with respect to the distributor plate 344.

The clip 352 further includes first and second members 380 and 382 that are resiliently biased toward the heater plate 346 to promote close contact of the heater plate 346 with the distributor plate 344. An extension member 384 of the distributor plate 344 extends through a hole 386 (seen in FIGS. 23 and 24) in the carrier 364 allowing the extension member 384 to surround a temperature switch 388 disposed on the circuit board 348 wherein the temperature switch is identical to the temperature switch 126 described above. The extension member 384 communicates the temperature of the heater plate 346 to the switch 388 to achieve proper temperature as noted above. A boss member 390 is disposed atop the carrier 364 wherein the boss member 390 is divided into first and second resilient portions 392*a* and 392*b* (seen most clearly in FIG. 21). The first portion 392*a* includes first and second splines 394*a* and 394*b* (visible in FIGS. 21 and 22, respectively). Referring to FIG. 23, when the boss member 390 is pushed through an orifice 396 in the circuit board 348, the portions 392*a* and 392*b* are pushed toward one another such that the boss member 390 assumes a sufficiently small shape to fit through the orifice 396, whereupon fitting through, the boss member 390 resiliently regains its former shape, thereby securing the carrier 364 to the circuit board 348. At this point, the circuit board 348 rests upon top surfaces of the splines 394*a*, 394*b*.

Referring to FIG. 24, the carrier 364 includes first and second sidewalls 398 and 400 that partially enclose the components mounted on the circuit board 348. The carrier 364 also includes a recess 402 in which first and second electrical components 404*a*, 404*b* (partially visible in FIG. 23) are disposed therein.

Referring to FIG. 23, a grommet 406 is retained by outer walls defining an opening 408 in a rear portion 410 of an inner enclosure member 412 that is similar to the enclosure member 140 discussed previously. An electrical power cord 415 passes through the grommet 406 and the opening 408 to supply current to the circuit board 348. The position of the cord 415 relative to the opening 408 is maintained in part by a flange 418 disposed around a periphery of the cord 415. The position of the cord 415 is further maintained by a cap 420 that presses the cord 415 against the member 412. The cap 420 is retained in position by first and second screws 422*a* and 422*b* that extend through first and second bores 424 and 426 in the cap 420 into first and second aligned bores 428 and 430 in the rear portion 410 of the member 412. The rear portion 410 also includes a recessed portion 432 that receives a portion of the cord 415 and a potting compound may be disposed within the recessed portion 432 to prevent seepage of material into the space occupied by the circuit board 348.

Referring to FIG. 24, the mounting plate 191 further includes a tab 434 with a slot 436 therein wherein the slot 436 receives a further tab 438 disposed on the enclosure member 412 to secure the member 412 to the mounting plate 191. A shouldered portion 440 (seen in FIG. 23) of the enclosure member 412 surrounds the O-ring 338 wherein the O-ring 338 forms a seal between the walls defining the portion 440 and the outer periphery of an upper surface of the heat exchanger 342, thereby preventing seepage of material into the space occupied by the circuit board 348.

First through fourth wall portions 442*a*–442*d* of the mounting plate 191 surround and abut an outer wall 445 of the enclosure member 412. The gasket 195 and layers of adhesive on both sides thereof are captured between a lower surface of the heat exchanger 342 and the surface 196 of the mounting plate 191 to prevent leakage of material therepast. First through sixth screws 446*a*–446*f* extend into bores of the mounting plate 191 and extend further into aligned bores 450*a*–450*f* of the enclosure member 412 to secure the plate 191 to the member 412.

Referring to FIG. 17, the path of the cord 415 is further illustrated wherein the cord 415 extends downwardly through a passage (not shown) in the collar 193 and a passage 453 in the main body portion 188 through a bifurcated channel member 456 disposed within the main body portion 188. The cord 415 further passes through a slot (not shown) defined by matching recesses 466 (one of which is visible in FIG. 17) disposed in the main body portion 188 and the base portion 173 and out of the apparatus. The channel member 456 separates the cord 415 from the can 24 when the can 24 is placed within the recess 22. The channel member 456 is retained in position by a post 467 that is integral with the base portion 173 wherein the post 467 is received in a slot 468 of the channel member 456. The member 456 is further retained in position by engagement of an upper flange 469 with walls defining the passage 453.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A container for product, comprising:

a container body defining a space for storage of the product;

a valve in fluid communication with the space; and a hollow stem in fluid communication with the valve and having a first wall portion extending from the container body to and contiguous with a second wall portion wherein the second wall portion is tapered and extends toward a reduced diameter tip terminating in an exterior end that has at least one side opening therethrough wherein the valve is actuable to dispense product through the side opening and wherein the first wall portion is non-tapered and lacks any side openings.

2. The container of claim 1, wherein the exterior end includes a profiled end surface that defines the at least one side opening.

3. The container of claim 2, wherein the profiled end surface forms a slot.

4. The container of claim 3, wherein the slot defines first and second side openings.

5. The container of claim 4, wherein each of the first and second side openings is defined by a base surface and a pair of side surfaces.

6. The container of claim 5, wherein the side surfaces are substantially perpendicular to the base surface.

7. The container of claim 2, wherein the profiled end surface forms a crenellated section.

8. A combination, comprising:

a container and a dispensing apparatus, the container including, a container body defining a space for storage of the product;

a valve in fluid communication with the space; and a hollow stem in fluid communication with the valve and terminating in an exterior end that has at least one side opening therethrough, the hollow stem further including a first tapered sealing surface disposed intermediate the side opening and the container body wherein the stem is adapted for engagement with the apparatus to permit dispensing of product through the side opening into the dispensing apparatus;

the dispensing apparatus including, a coupling member having a second sealing surface that seals against the first sealing surface forming a continuous seal that prohibits flow of product past the seal.

9. The container of claim 8, wherein the exterior end includes a profiled end surface that defines the at least one side opening.

10. The container of claim 9, wherein the profiled end surface forms a slot.

11. The container of claim 10, wherein the slot defines first and second side openings.

12. The container of claim 11, wherein each of the first and second side openings is defined by a base surface and a pair of side surfaces.

13. The container of claim 12, wherein the side surfaces are substantially perpendicular to the base surface.

14. The container of claim 9, wherein the profiled end surface forms a crenellated section.

15. The combination of claim 8, wherein the hollow stem has a first wall portion extending from the container body to and contiguous with a second wall portion wherein the second wall portion defines the first tapered sealing surface and wherein the first wall portion is non-tapered and lacks any side openings.

16. A container for product, comprising:

a container body defining a space for storage of the product;

a valve in fluid communication with the space; and a hollow stem in fluid communication with the valve and having a tapered outside surface extending to a reduced diameter tip terminating in an exterior end that has at least one side opening therethrough wherein the valve is actuable to dispense product through the side opening wherein the container has pressurized product therein in combination with a dispensing apparatus adapted to dispense product and having a coupling assembly and a dispenser inlet valve, wherein the container is engaged by the coupling assembly wherein the hollow stem is adapted to for engagement with the dispenser inlet valve to permit dispensing of product through the at least one side opening into a chamber of the dispensing apparatus, and wherein the chamber temporarily stores product prior to dispensing product from the apparatus.

17. A combination, comprising;

a dispensing apparatus adapted to dispense product and having a coupling assembly and a dispenser inlet valve; and a container of pressurized product disposed in the dispenser and engaged by the coupling assembly;

wherein the container includes a container body defining a space for storage of the product, a container valve in fluid communication with the space and a hollow stem in fluid communication with the valve wherein the hollow stem has an exterior end that has at least one side opening therethrough and wherein the hollow stem is adapted for engagment with the dispenser inlet valve to permit dispensing of product through the at least one side opening into the dispensing apparatus and wherein the coupling assembly includes a first sealing element engageable with the main body portion and a second sealing element engageable with the end surface.

18. The combination of claim 17, wherein the second sealing element is spring-biased and movable from a closed position to an open position when engaged by the valve.

19. The combination of claim 18, wherein the second sealing element includes a substantially spherical sealing surface.

20. The combination of claim 19, wherein the first sealing element forms a part of a hollow collar assembly having an interior chamber within which the second sealing element is disposed.

21. The combination of claim 20, wherein the collar assembly includes a first tapered surface and the main body portion of the valve includes a second tapered surface engageable with the first tapered surface to seal the interior chamber.

22. The combination of claim 21, wherein the first tapered surface and the second tapered surface are tapered at different angles.

23. The combination of claim 17, wherein the exterior end includes a slot that defines first and second side openings.

24. The combination of claim 23, wherein each of the first and second side openings is defined by a base surface and a pair of side surfaces substantially perpendicular to the base surface.

25. The combination of claim 17, wherein the profiled end surface forms a crenellated section.

* * * * *